US011390073B2

(12) United States Patent
Ota et al.

(10) Patent No.: US 11,390,073 B2
(45) Date of Patent: Jul. 19, 2022

(54) LIQUID DISCHARGE APPARATUS

(71) Applicant: BROTHER KOGYO KABUSHIKI KAISHA, Nagoya (JP)

(72) Inventors: Shoko Ota, Okazaki (JP); Shoji Sato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 18 days.

(21) Appl. No.: 17/148,048

(22) Filed: Jan. 13, 2021

(65) Prior Publication Data

US 2021/0213733 A1 Jul. 15, 2021

(30) Foreign Application Priority Data

Jan. 14, 2020 (JP) ..... JP2020-003725

(51) Int. Cl.
*B41J 2/045* (2006.01)

(52) U.S. Cl.
CPC ..... *B41J 2/04573* (2013.01); *B41J 2/04563* (2013.01)

(58) Field of Classification Search
CPC .. B41J 2/04573; B41J 2/04563; B41J 2/0458; B41J 2/04553; B41J 2/04581; B41J 3/543
See application file for complete search history.

(56) References Cited

U.S. PATENT DOCUMENTS

| | | | | |
|---|---|---|---|---|
| 10,035,344 | B2 * | 7/2018 | Koizumi | B41J 2/0458 |
| 2007/0103496 | A1 | 5/2007 | Otani | |
| 2008/0080013 | A1 | 4/2008 | Akiyama | |

FOREIGN PATENT DOCUMENTS

| | | | |
|---|---|---|---|
| JP | 2001-277633 | A | 10/2001 |
| JP | 2003-211734 | A | 7/2003 |
| JP | 2007-145008 | A | 6/2007 |
| JP | 2008-092340 | A | 4/2008 |

* cited by examiner

*Primary Examiner* — Thinh H Nguyen
(74) *Attorney, Agent, or Firm* — Merchant & Gould P.C.

(57) ABSTRACT

A liquid discharge apparatus includes a liquid discharge head, a carriage which has the liquid discharge head mounted thereto and moves in a scanning direction, an encoder sensor mounted to the carriage, a slit member extending in the scanning direction and having encoder slits aligned in the scanning direction and detected by the encoder sensor, and a controller. The controller moves the carriage in the scanning direction, generates multiplied signals by multiplying a detection signal obtained based on a detection result of the encoder slits by the encoder sensor when a signal change occurs in the detection signal, and causes the liquid discharge head to discharge liquid from nozzles, based on the multiplied signals.

16 Claims, 24 Drawing Sheets

LIQUID DISCHARGE APPARATUS

CROSS-REFERENCE TO RELATED APPLICATION

This application is based upon and claims the benefit of priority from prior Japanese patent application No. 2020-003725, filed on Jan. 14, 2020, the entire contents of which are incorporated herein by reference.

TECHNICAL FIELD

The present disclosure relates to a liquid discharge apparatus configured to discharge liquid from nozzles.

BACKGROUND

As an example of a liquid discharge apparatus configured to discharge liquid from nozzles, JP-B-3622628 discloses an inkjet printer configured to discharge ink from nozzles for recording. In the inkjet printer disclosed in JP-B-3622628, a signal obtained by multiplying a pulse signal that is output from an encoder based on relative movement of a print head with respect to a sheet is output to the print head, so that the print head is caused to discharge ink from the nozzles.

SUMMARY

In the inkjet printer disclosed in JP-B-3622628, contaminants such as ink may be attached to the encoder. In this case, a period of the pulse signal that is output from the encoder changes when the print head passes a part of the encoder to which contaminants are attached. As a result, a period of the signal obtained by multiplying the pulse signal also changes, so that a discharge interval of ink from the nozzles may become too long or too short. In a printer configured to discharge ink from a print head while relatively moving the print head and a sheet by conveying the sheet with conveyor rollers and the like and in an inkjet printer configured to discharge ink from nozzles on the basis of a signal from an encoder corresponding to a conveying amount of a sheet, the similar problems occur.

An object of the present disclosure is to provide a liquid discharge apparatus that enables to discharge liquid from a nozzle at an appropriate timing.

A first aspect of the present disclosure is a liquid discharge apparatus including:

a liquid discharge head having a nozzle;

a carriage having the liquid discharge head mounted thereto, and configured to move in a scanning direction;

an encoder sensor mounted to the carriage;

a slit member extending in the scanning direction, and having a plurality of encoder slits aligned in the scanning direction and detected by the encoder sensor; and a controller configured to:

move the carriage in the scanning direction;

generate a plurality of multiplied signals by multiplying a detection signal obtained based on a detection result of the encoder slits by the encoder sensor, in a case where a signal change occurs in the detection signal, the signal change being either a rise or a fall of the detection signal; and cause the liquid discharge head to discharge liquid from the nozzle, based on the plurality of multiplied signals, in which in a case where the controller generates the plurality of multiplied signals as a result of occurrence of an $N^{th}$ signal change in the detection signal after starting to move the carriage, where N is a natural number of 2 or greater, the controller is configured to calculate a target value $P_N$ of a number of the multiplied signals that are generated in a case where the $N^{th}$ signal change occurs, based on $P_N=PA_N+(P_{N-1}-PR_{N-1})$, where $P_{N-1}$ is a target value of a number of the multiplied signals that are generated in a case where an $[N-1]^{th}$ signal change occurs in the detection signal, $PR_{N-1}$ is a number of the multiplied signals that are actually generated during an $[N-1]^{th}$ detection time period that is a period of time from the $[N-1]^{th}$ signal change to the $N^{th}$ signal change, and $PA_N$ is a standard value of a number of the multiplied signals for an $N^{th}$ detection time period, in a case where an actual length $TR_{N-1}$ of the $[N-1]^{th}$ detection time period is equal to or longer than a predetermined first time and equal to or shorter than a predetermined second time, the controller is configured to generate the multiplied signals for each time calculated as $[TE_N/P_N]$ in the case where the $N^{th}$ signal change occurs, where $TE_N$ is a standard value of a length of the $N^{th}$ detection time period, and in a case where the actual length $TR_{N-1}$ is shorter than the predetermined first time, the controller is configured to generate the multiplied signals for each time calculated as $[(2\times TE_N-TR_{N-1})/P_N]$ in the case where the $N^{th}$ signal change occurs.

A second aspect of the present disclosure is a liquid discharge apparatus including:

a liquid discharge head having a nozzle;

a conveyor configured to convey a medium, to which liquid is discharged from the nozzle, in a conveying direction;

an encoder sensor;

a slit member configured to relatively move in a predetermined direction with respect to the encoder sensor in a case where the medium is conveyed by the conveyor, and having a plurality of encoder slits aligned in the predetermined direction and detected by the encoder sensor; and a controller configured to:

cause the conveyor to convey the medium;

generate a plurality of multiplied signals by multiplying a detection signal obtained based on a detection result of the encoder slit by the encoder sensor, in a case where a signal change occurs in the detection signal, the signal change being either a rise or a fall of the detection signal; and cause the liquid discharge head to discharge liquid from the nozzle, based on the plurality of multiplied signals, in which in a case where the controller generates the plurality of multiplied signals as a result of occurrence of an $N^{th}$ signal change in the detection signal after starting to convey the medium, where N is a natural number of 2 or greater, the controller is configured to calculate a target value $P_N$ of a number of the multiplied signals that are generated in a case where the $N^{th}$ signal change occurs, based on $P_N=PA_N+(P_{N-1}-PR_{N-1})$, where $P_{N-1}$ is a target value of a number of the multiplied signals that are generated in a case where an $[N-1]^{th}$ signal change occurs in the detection signal, $PR_{N-1}$ is a number of the multiplied signals that are actually generated during an $[N-1]^{th}$ detection time period that is a period of time from the $[N-1]^{th}$ signal change to the $N^{th}$ signal change, and $PA_N$ is a standard value of a number of the multiplied signals for an $N^{th}$ detection time period, in a case where an actual length $TR_{N-1}$ of the $[N-1]^{th}$ detection time period is equal to or longer than a predetermined first time and equal to or shorter than a predetermined second time, the controller generates the multiplied signals for each time calculated as $[TE_N/P_N]$ in the case where the $N^{th}$ signal change occurs, where $TE_N$ is a standard value of a length of the $N^{th}$ detection time period, and in a case where the actual length $TR_{N-1}$ is shorter than the predetermined first time, the controller is configured to generate the multiplied signals for each time calculated as $[(2\times TE_N-TR_{N-1})/P_N]$ in a case where the $N^{th}$ signal change occurs.

A third aspect of the present disclosure is a liquid discharge apparatus including:

a liquid discharge head having a nozzle;

a carriage having the liquid discharge head mounted thereto, and configured to move in a scanning direction;

an encoder sensor mounted to the carriage;

a slit member extending in the scanning direction, and having a plurality of encoder slits aligned in the scanning direction and detected by the encoder sensor; and a controller configured to:

move the carriage in the scanning direction;

generate a plurality of multiplied signals by multiplying a detection signal obtained based on a detection result of the encoder slits by the encoder sensor, in a case where a signal change occurs in the detection signal, the signal change being either a rise or a fall of the detection signal; and cause the liquid discharge head to discharge liquid from the nozzle, based on the plurality of multiplied signals, in which in a case where the controller generates the plurality of multiplied signals as a result of occurrence of an $N^{th}$ signal change in the detection signal after starting to move the carriage, where N is a natural number of 2 or greater, in a case where an actual length $TR_{N-1}$ of an $[N-1]^{th}$ detection time period that is a period of time from an $[N-1]^{th}$ signal change to an $N^{th}$ signal change is equal to or longer than a predetermined first time and equal to or shorter than a predetermined second time, the controller is configured to:

calculate a target value $P_N$ of a number of the multiplied signals that are generated in a case where the $N^{th}$ signal change occurs, based on $P_N=PA_N+(P_{N-1}-PR_{N-1})$, where $PR_{N-1}$ is a number of the multiplied signals that are actually generated during the $[N-1]^{th}$ detection time period, and $PA_N$ is a standard value of a number of the multiplied signals for an $N^{th}$ detection time period, and generate the multiplied signals for each time calculated as $[TE_N/P_N]$ in a case where the $N^{th}$ signal change occurs, where $TE_N$ is a standard value of a length of the $N^{th}$ detection time period, and in a case where the actual length $TR_{N-1}$ is longer than the predetermined second time, the controller is configured to:

calculate the target value $P_N$ of the number of the multiplied signals that are generated in the case where the $N^{th}$ signal change occurs, based on $P_N=(M_{N-1}+1)\times PA_N+(P_{N-1}-PR_{N-1})$, where $M_{N-1}$ is a number of the encoder slits that are not detected during the [N−1] detection time period, and generate the multiplied signals for each time calculated as $[(2\times TE_N-TR_{N-1}+M_{N-1}\times C_{N-1})/P_N]$ in the case where the $N^{th}$ signal change occurs, where $C_{N-1}$ is a standard value of a length of the $[N-1]^{th}$ detection time period.

A fourth aspect of the present disclosure is a liquid discharge apparatus including:

a liquid discharge head having a nozzle;

a conveyor configured to convey a medium, to which liquid is discharged from the nozzle, in a conveying direction;

an encoder sensor;

a slit member configured to relatively move in a predetermined direction with respect to the encoder sensor in a case where the medium is conveyed by the conveyor, and having a plurality of encoder slits aligned in the predetermined direction and detected by the encoder sensor; and a controller configured to:

cause the conveyor to convey the medium;

generate a plurality of multiplied signals by multiplying a detection signal obtained based on a detection result of the encoder slit by the encoder sensor, in a case where a signal change occurs in the detection signal, the signal change being either a rise or a fall of the detection signal; and cause the liquid discharge head to discharge liquid from the nozzles, based on the plurality of multiplied signals, in which in a case where the controller generates the plurality of multiplied signals as a result of occurrence of an $N^{th}$ signal change in the detection signal after starting to convey the medium, where N is a natural number of 2 or greater, in a case where an actual length $TR_{N-1}$ of an $[N-1]^{th}$ detection time period that is a period of time from an $[N-1]^{th}$ signal change to an $N^{th}$ signal change is equal to or longer than a predetermined first time and equal to or shorter than a predetermined second time, the controller is configured to:

calculate a target value $P_N$ of a number of the multiplied signals that are generated in a case where the $N^{th}$ signal change occurs, based on $P_N=PA_N+(P_{N-1}-PR_{N-1})$, where $PR_{N-1}$ is a number of the multiplied signals that are actually generated during the $[N-1]^{th}$ detection time period, and $PA_N$ is a standard value of a number of the multiplied signals for an $N^{th}$ detection time period, and generate the multiplied signals for each time calculated as $[TE_N/P_N]$ in a case where the $N^{th}$ signal change occurs, where $TE_N$ is a standard value of a length of the $N^{th}$ detection time period, and in a case where the actual length $TR_{N-1}$ is longer than the predetermined second time, the controller is configured to:

calculate the target value $P_N$ of the number of the multiplied signals that are generated in the case where the $N^{th}$ signal change occurs, based on $P_N=(M_{N-1}+1)\times PA_N+(P_{N-1}-PR_{N-1})$, where $M_{N-1}$ is a number of the encoder slits that are not detected during the [N−1] detection time period, and generate the multiplied signals for each time calculated as $[(2\times TE_N-TR_{N-1}+M_{N-1}\times C_{N-1})/P_N]$ in a case where the $N^{th}$ signal change occurs, where $C_{N-1}$ is a standard value of a length of the $[N-1]^{th}$ detection time period.

According to the liquid discharge apparatus of the present disclosure, it is possible to generate the multiplied signals at an appropriate time interval even in a case where contaminants are attached to the encoder slits, for example.

DETAILED DESCRIPTION

First Embodiment

A first embodiment of the present disclosure is described.

Figure 1:
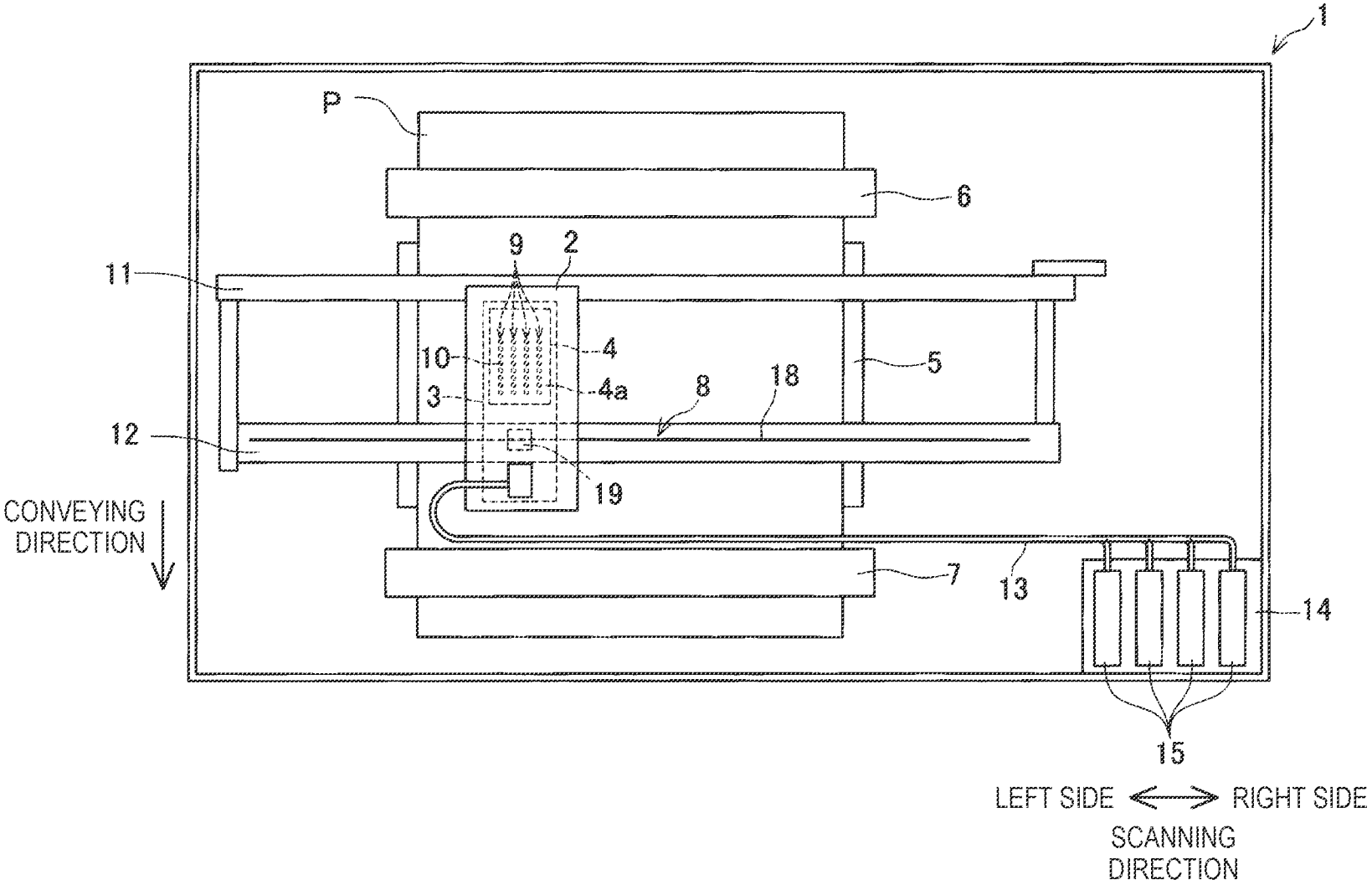
FIG. 1 is a schematic configuration view of a printer in accordance with a first embodiment of the present disclosure.

As shown in FIG. 1, a printer 1 in accordance with the first embodiment ("liquid discharge apparatus" of the present disclosure) includes a carriage 2, a sub-tank 3, an inkjet head 4 ("liquid discharge head" of the present disclosure), a platen 5, conveyor rollers 6 and 7, a linear encoder 8, and the like.

The carriage 2 is supported to two guide rails 11 and 12 extending in a scanning direction. The carriage 2 is connected to a carriage motor 56 (refer to FIG. 3) via a belt and the like (not shown), and when the carriage motor 56 is driven, the carriage 2 moves in the scanning direction along the guide rails 11 and 12. In the below, the right side and the left side in the scanning direction are defined and described, as shown in FIG. 1.

The sub-tank 3 is mounted to the carriage 2. Herein, the printer 1 is provided with a cartridge holder 14 at an end portion on the right side in the scanning direction and on a downstream side with respect to a conveying direction of a recording sheet P ("medium" of the present disclosure) orthogonal to the scanning direction. Four ink cartridges 15 aligned side by side in the scanning direction are removably mounted to the cartridge holder 14. Black, yellow, cyan and magenta inks ("liquid" of the present disclosure) are stored in the four ink cartridges 15 from those arranged on the right side in the scanning direction. The sub-tank 3 is connected to the four ink cartridges 15 mounted to the cartridge holder 14, via four tubes 13. Thereby, the inks of four colors are supplied from the four ink cartridges 15 to the sub-tank 3.

The inkjet head 4 is mounted to the carriage 2, and is connected to a lower end portion of the sub-tank 3. Thereby, the inkjet head 4 and the ink cartridges 15 are connected to each other via the tubes 13 and the sub-tank 3. The inks of four colors are supplied from the sub-tank 3 to the inkjet head 4. The inkjet head 4 is also configured to discharge the inks from a plurality of nozzles 10 formed in a nozzle surface 4*a* that is a lower surface of the inkjet head and is parallel to the scanning direction and the conveying direction. More specifically, the plurality of nozzles 10 is aligned in the conveying direction to form nozzle rows 9, so that the inkjet head 4 has four nozzle rows 9 aligned side by side in the scanning direction. From the plurality of nozzles 10, black, yellow, cyan and magenta inks are discharged from the nozzles 10, from those configuring the nozzle row 9 on the right side in the scanning direction.

The platen 5 is disposed below the inkjet head 4, and faces the plurality of nozzles 10. The platen 5 extends over an entire length of the recording sheet P in the scanning direction, and is configured to support the recording sheet P from below. The conveyor roller 6 is disposed upstream of the inkjet head 4 and the platen 5 with respect to the conveying direction. The conveyor roller 7 is disposed downstream of the inkjet head 4 and the platen 5 with respect to the conveying direction. The conveyor rollers 6 and 7 are connected to a conveyor motor 57 (refer to FIG. 3) via a gear and the like (not shown). When the conveyor motor 57 is driven, the conveyor rollers 6 and 7 are rotated to convey the recording sheet P in the conveying direction.

Figure 2A:
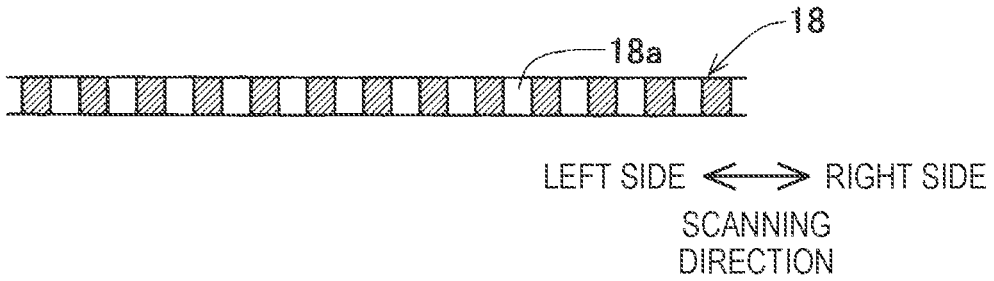
FIG. 2A depicts an encoder scale shown in FIG. 1, as seen from a downstream side with respect to a conveying direction.

The linear encoder 8 includes an encoder scale 18 ("slit member" of the present disclosure) and an encoder sensor 19. The encoder scale 18 is disposed on the guide rail 12. The encoder scale 18 extends over an entire length of the guide rail 12 in the scanning direction. As shown in FIG. 2A, the encoder scale 18 has a plurality of encoder slits 18*a* having translucency and disposed at constant intervals in the scanning direction.

Figure 2B:
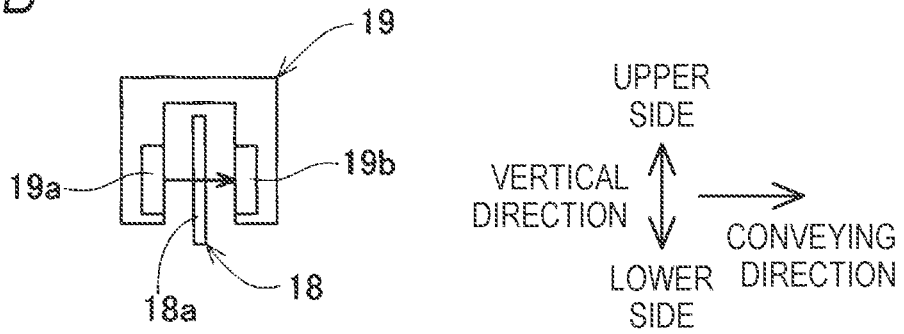
FIG. 2B depicts the encoder scale and an encoder sensor in a state where the encoder sensor faces an encoder slit of the encoder scale, as seen from a left side in a scanning direction.
Figure 2C:
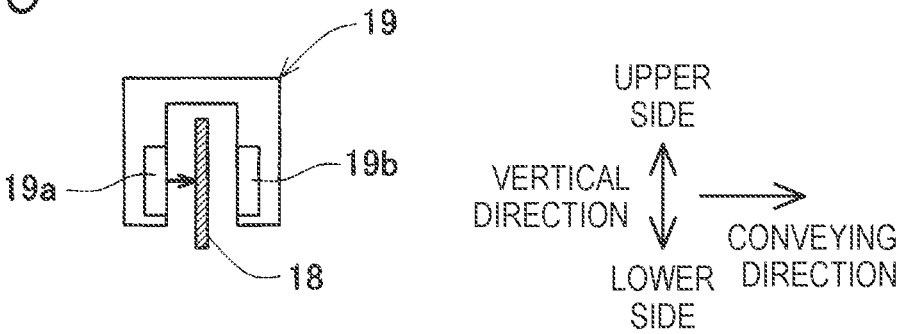
FIG. 2C depicts the encoder scale and the encoder sensor in a state where the encoder sensor does not face the encoder slit of the encoder scale, as seen from the left side in the scanning direction.

The encoder sensor 19 is mounted to the carriage 2. As shown in FIGS. 2B and 2C, the encoder sensor 19 has a light-emitting element 19*a* and a light-receiving element 19*b*. The light-emitting element 19*a* and the light-receiving element 19*b* are disposed facing each other in the conveying direction. The encoder scale 18 is disposed between the light-emitting element 19*a* and the light-receiving element 19*b* in the conveying direction, and the light-emitting element 19*a* and the light-receiving element 19*b* face each other with the encoder scale 18 being sandwiched therebetween. The light-emitting element 19*a* is configured to irradiate light toward the light-receiving element 19*b*.

In a state where the encoder sensor 19 (the light-emitting element 19*a* and the light-receiving element 19*b*) is located at the same position as the encoder slit 18*a* of the encoder scale 18 in the scanning direction, as shown in FIG. 2B, the light irradiated from the light-emitting element 19*a* passes through the encoder slit 18*a* and is then received in the light-receiving element 19*b*. On the other hand, in a state where the encoder sensor 19 (the light-emitting element 19*a* and the light-receiving element 19*b*) is located between the two adjacent encoder slits 18*a* of the encoder scale 18 in the scanning direction, as shown in FIG. 2C, the light irradiated from the light-emitting element 19*a* is blocked by the encoder scale 18 and is not thus received in the light-receiving element 19*b*.

The encoder sensor 19 is configured to output a signal indicating whether the light from the light-emitting element 19*a* is received in the light-receiving element 19*b*. More specifically, the encoder sensor 19 is configured to transmit an encoder signal that is a pulse signal that rises when a state is switched from a state in which the light irradiated from the light-emitting element 19*a* is received in the light-receiving element 19*b* to a state in which the light is not received in the light-receiving element 19*b* and falls when a state is switched from the state in which the light irradiated from the light-emitting element 19*a* is not received in the light-receiving element 19*b* to the state in which the light is received in the light-receiving element 19*b*.

<Electrical Configuration of Printer>

Figure 3:
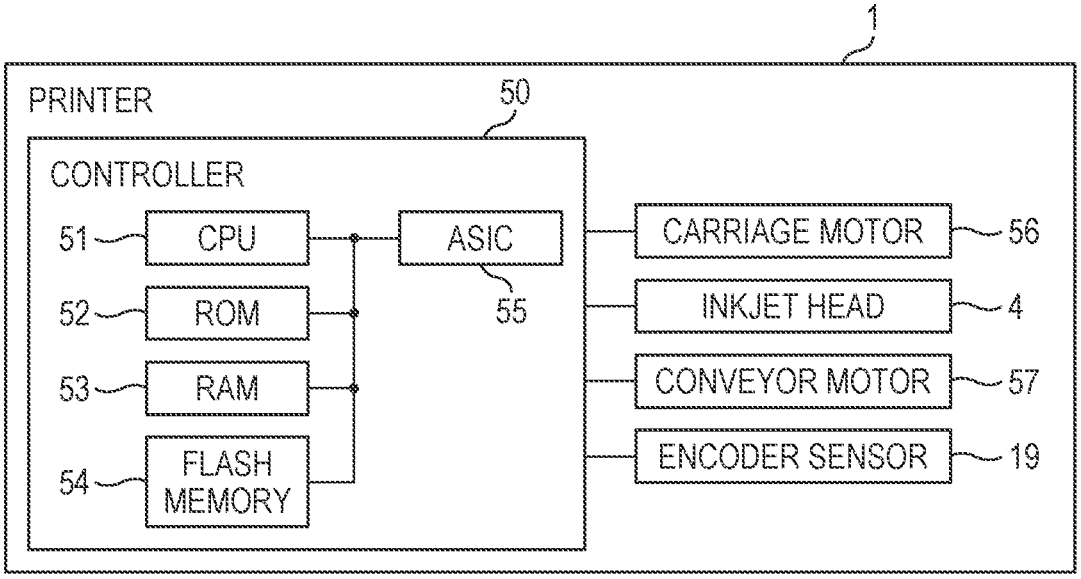
FIG. 3 is a block diagram depicting an electric configuration of the printer in accordance with the first embodiment.

Subsequently, an electrical configuration of the printer 1 is described. Operations of the printer 1 are controlled by a controller 50. As shown in FIG. 3, the controller 50 includes a CPU (Central Processing Unit) 51, a ROM (Read Only Memory) 52, a RAM (Random Access Memory) 53, a flash memory 54, an ASIC (Application Specific Integrated Circuit) 55 and the like, and is configured to control operations of the carriage motor 56, the inkjet head 4, the conveyor motor 57 and the like. The controller 50 is also configured to receive the encoder signal transmitted from the encoder sensor 19.

Note that, the controller 50 may also be configured so that only the CPU 51 executes a variety of processing, only the ASIC 55 executes a variety of processing, or the CPU 51 and the ASIC 55 execute a variety of processing in cooperation with each other. The controller 50 may also be configured so that one CPU 51 solely executes processing or a plurality of CPUs 51 shares and executes processing. The controller 50 may also be configured so that one ASIC 55 solely executes processing or a plurality of ASICs 55 shares and executes processing.

<Control Upon Recording>

Subsequently, control that is executed when performing recording on the recording sheet P in the printer 1 is described. In the printer 1, the controller 50 alternately and repeatedly performs a recording pass of controlling the inkjet head 4 to discharge inks from the plurality of nozzles 10 toward the recording sheet P while controlling the carriage motor 56 to move the carriage 2 in the scanning direction, and a conveying operation of controlling the conveyor motor 57 to convey the recording sheet P to the conveyor rollers 6 and 7, thereby performing recording on the recording sheet P.

<Generation of Multiplied Signal>

When performing the recording pass, the encoder sensor 19 is moved in the scanning direction together with the carriage 2, so that the encoder sensor 19 and the encoder scale 18 relatively move in the scanning direction and the encoder signal as described above is output from the encoder sensor 19.

When performing the recording pass, the controller 50 generates multiplied signals that are pulse signals obtained by multiplying the encoder signal received from the encoder sensor 19. Then, the controller 50 causes the inkjet head 4 to discharge the inks from the plurality of nozzles 10 at a timing at which a rise occurs in the generated multiplied signal, for example. In the below, the generation of the multiplied signals is described.

Figure 4:
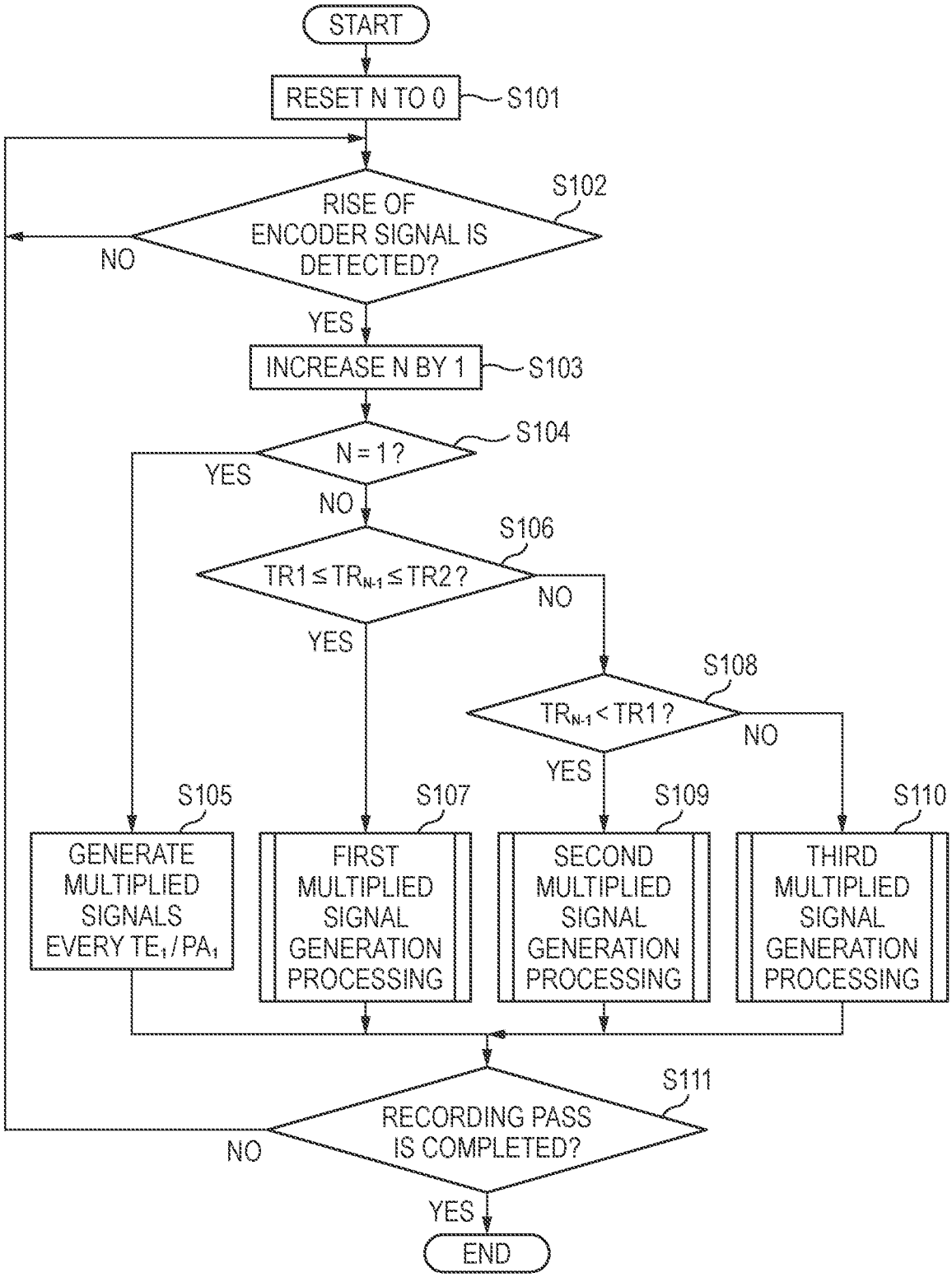
FIG. 4 is a flowchart depicting a processing flow for generating multiplied signals in the first embodiment.

In the first embodiment, when the recording pass starts, the controller 50 executes processing according to a flow shown in FIG. 4, thereby generating the multiplied signal.

More specifically, when the recording pass starts, the controller 50 first resets a variable N to zero (0) (S101). The variable N corresponds to the number of detection times of the rise of the encoder signal after the carriage 2 starts to move in the recording pass.

Then, the controller 50 stands by until a rise ("signal change" of the present disclosure) of the encoder signal is detected (S102: NO), and increase the variable N by 1 when the rise of the encoder signal is detected (S102: YES) (S103). In a case where the variable N is 1 (S104: YES), the controller 50 generates the multiplied signals every $[TE_1/PA_1]$ (S105), and proceeds to S111. Herein, $TE_1$ and $PA_1$ are values set in advance by a test and the like, and are stored in the flash memory 54 and the like.

Note that, since the processing of multiplying the encoder signal to generate the multiplied signals in S103 or S205, S305 and S406, which will be described later, is well known, as disclosed in Japanese Patent No. 3,622,628, for example, the detailed descriptions thereof are omitted herein.

When the variable N is 2 or greater (S104: NO), the controller 50 determines whether $TR_{N-1}$ is equal to or longer than a predetermined TR1 ("predetermined first time" of the present disclosure) and equal to or shorter than a predetermined TR2 ("predetermined second time" of the present disclosure) (S106). Herein, $TR_{N-1}$ is an actual length of a period of time (([N−1]$^{th}$ detection time period) from detection of an [N−1]$^{th}$ rise of the encoder signal to detection of a N$^{th}$ rise of the encoder signal.

In the recording pass, when contaminants and the like are not attached to the encoder scale 18 and the carriage 2 moves at a predetermined speed, a variation occurs in the length of the detection time period due to variation in the moving speed of the carriage 2. TR1 is, for example, a lower limit value of the variation in the length of the detection time period. TR2 is, for example, an upper limit value of the variation in the length of the detection time period.

When it is determined that $TR_{N-1}$ is equal to or longer than TR1 and equal to or shorter than TR2 (S106: YES), the controller 50 executes first multiplied signal generation processing (S107), and proceeds to S111.

When it is determined that $TR_{N-1}$ is not equal to or longer than TR1 and equal to or shorter than TR2 (S106: NO), the controller 50 determines whether $TR_{N-1}$ is shorter than TR1 (S108). When it is determined that $TR_{N-1}$ is shorter than TR1 (S108: YES), the controller 50 executes second multiplied signal generation processing (S109), and proceeds to S111. When it is determined that $TR_{N-1}$ is longer than TR2 (S108: NO), the controller 50 executes third multiplied signal generation processing (S110), and proceeds to S111.

In S111, the controller 50 determines whether the recording pass is completed. When it is determined that the recording pass is not completed (S111: NO), the controller 50 returns to S102, and when it is determined that the recording pass is completed, the controller 50 ends the processing.

<First Multiplied Signal Generation Processing>

Figure 5:
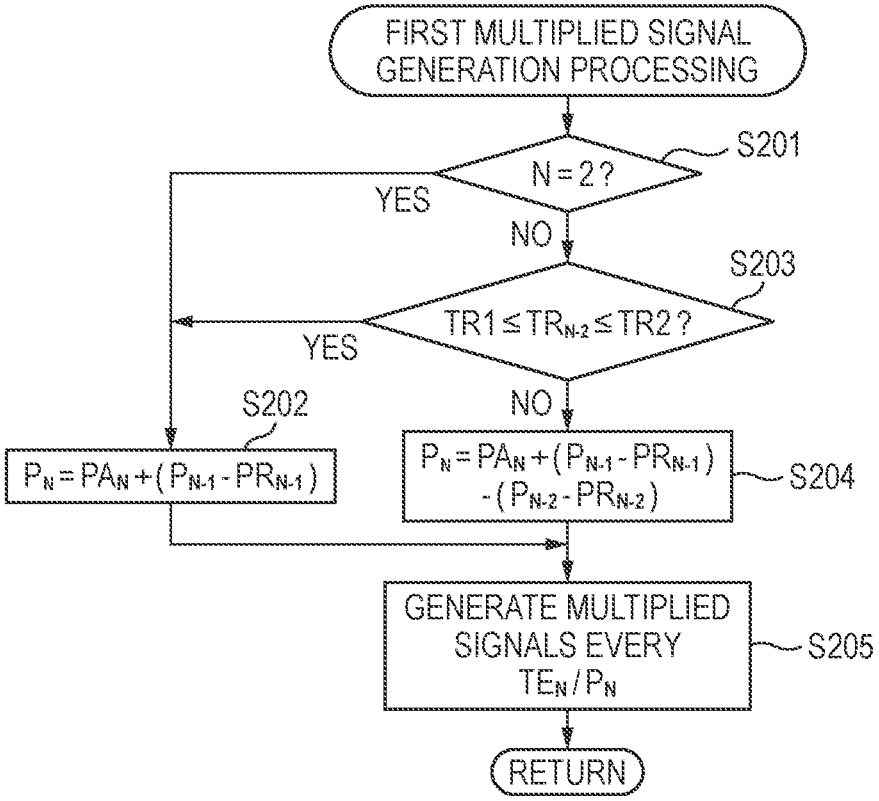
FIG. 5 is a flowchart depicting first multiplied signal generation processing of FIG. 4.

Subsequently, the first multiplied signal generation processing of S107 is described. As shown in FIG. 5, in the first multiplied signal generation processing, the controller 50 first determines whether the variable N is 2 (S201). When it is determined that the variable N is 2 (S201: YES), the controller 50 calculates a target value $P_N$ of the number of multiplied signals that are generated for a N$^{th}$ detection time period, based on $P_N=PA_N+(P_{N-1}-PR_{N-1})$ (S202).

Herein, $P_{N-1}$ is a target value of the number of multiplied signals that are generated during an [N−1]$^{th}$ detection time period. $PA_N$ is a standard value of the number of multiplied signals that are generated during the N$^{th}$ detection time period, and is stored in advance in the flash memory 54. $PR_{N-1}$ is the number of multiplied signals actually generated during the [N−1]$^{th}$ detection time period.

When it is determined that the variable N is not 2, i.e., the variable N is 3 or greater (S201: NO), the controller 50 determines whether $TR_{N-2}$ is equal to or longer than TR1 and equal to or shorter than TR2 (S203). When it is determined that $TR_{N-2}$ is equal to or longer than TR1 and equal to or shorter than TR2 (S203: YES), the controller 50 calculates $P_N$, based on $P_N=PA_N+(P_{N-1}-PR_{N-1})$, in a similar manner to described above (S202).

When it is determined that $TR_{N-2}$ is not equal to or longer than TR1 and equal to or shorter than TR2 (shorter than TR1 or longer than TR2) (S203: NO), the controller 50 calculates $P_N$, based on $P_N=PA_N+(P_{N-1}-PR_{N-1})-(P_{N-2}-PR_{N-2})$ (S204).

After calculating $P_N$ in S202 or S204, the controller 50 generates the multiplied signals every $[TE_N/P_N]$ (S205). Herein, $TE_N$ is an expected value of the N$^{th}$ detection time period. $TE_N$ is, for example, an average value of a predetermined number of times of past detection time periods before the N$^{th}$ detection time period. Alternatively, $TE_N$ may also be preset and stored in the flash memory 54.

<Second Multiplied Signal Generation Processing>

Figure 6:
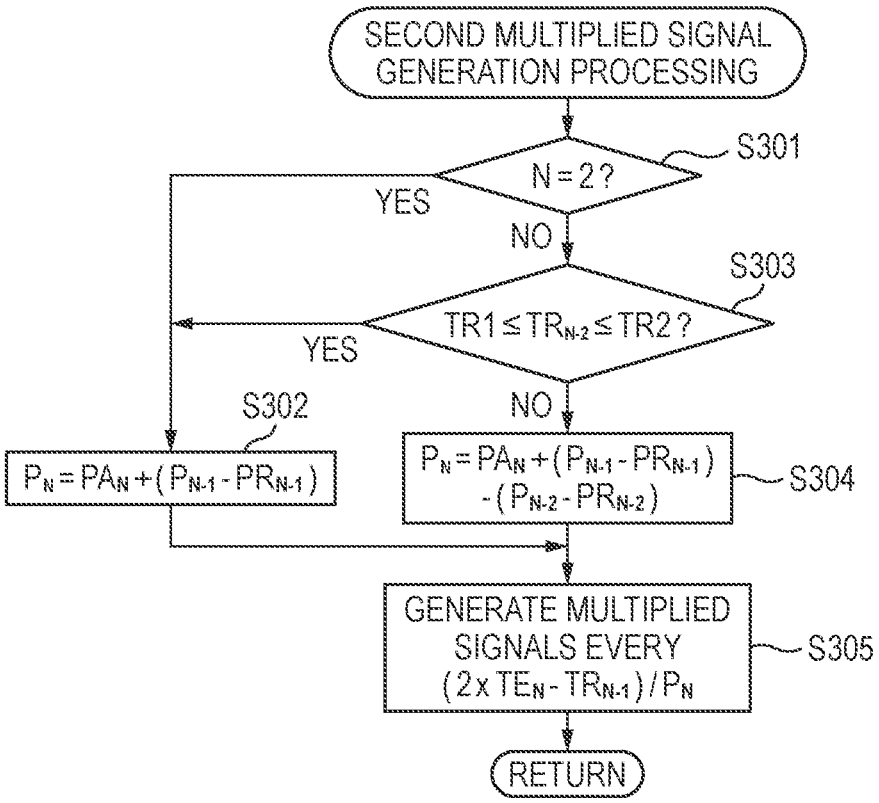
FIG. 6 is a flowchart depicting second multiplied signal generation processing of FIG. 4.

Subsequently, the second multiplied signal generation processing of S109 is described. As shown in FIG. 6, in the second multiplied signal generation processing, the controller 50 executes processing of S301 to S304 similar to S201 to S204 of the first multiplied signal generation processing. After calculating $P_N$ in S302 or S304, the controller 50 generates the multiplied signals every $[(2\times TE_N-TR_{N-1})/P_N]$ (S305).

<Third Multiplied Signal Generation Processing>

Figure 7:
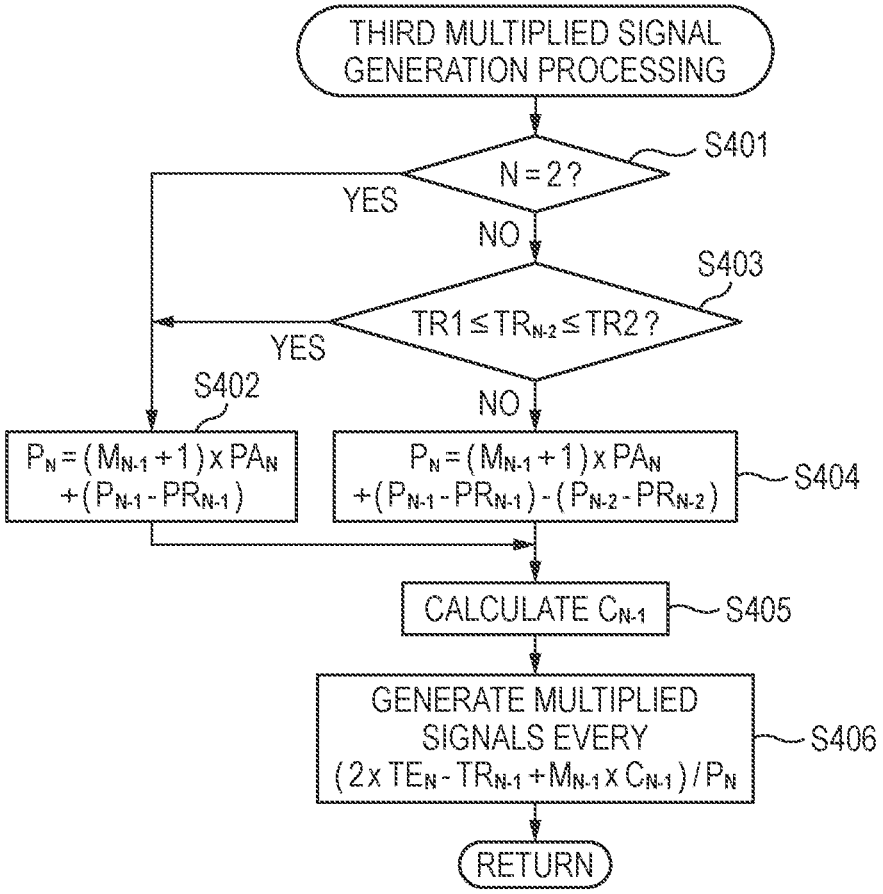
FIG. 7 is a flowchart depicting third multiplied signal generation processing of FIG. 4.

Subsequently, the third multiplied signal generation processing of S110 is described. As shown in FIG. 7, in the third multiplied signal generation processing, the controller 50 first determines whether the variable N is 2 (S401). When it is determined that the variable N is 2 (S401: YES), the controller 50 calculates $P_N$, based on $P_N=(M_{N-1}+1)\times PA_N+(P_{N-1}-PR_{N-1})$ (S402). Herein, $M_{N-1}$ is the number of the encoder slits 18*a* that are not detected during the [N−1]$^{th}$ detection time period. A value of $M_{N-1}$ is set as processing is executed according to a flow shown in FIG. 8, which will be described later.

When it is determined that the variable N is 3 or greater (S401: NO), the controller 50 determines whether $TR_{N-2}$ is equal to or longer than TR1 and equal to or shorter than TR2 (S403). When it is determined that $TR_{N-2}$ is equal to or longer than TR1 and equal to or shorter than TR2 (S403: YES), the controller 50 calculates $P_N$, based on $P_N=(M_{N-1}+1)\times PA_N+(P_{N-1}-PR_{N-1})$, in a similar manner to described above (S402).

When it is determined that $TR_{N-2}$ is not equal to or longer than TR1 and equal to or shorter than TR2 (shorter than TR1 or longer than TR2) (S403: NO), the controller 50 calculates $P_N$, based on $P_N=(M_{N-1}+1)\times PA_N+(P_{N-1}-PR_{N-1})-(P_{N-2}-PR_{N-2})$ (S404).

After calculating $P_N$ in S402 or S404, the controller 50 calculates a value of $C_{N-1}$ that is a standard value of the length of the [N−1]$^{th}$ detection time period (S405). In S405, the controller 50 calculates, as the value of $C_{N-1}$, an average value of lengths of a predetermined number of times of past detection time periods before the N$^{th}$ detection time period. Then, the controller 50 generates the multiplied signals every $[(2\times TE_N-TR_{N-1}+M_{N-1}\times C_{N-1})/P_N]$ (S406).

<Position Parameter>

Subsequently, a position parameter U is described. In the first embodiment, the controller 50 acquires position information of the carriage 2 in the scanning direction, based on a value of a position parameter U. In the first embodiment, when performing the recording pass, the controller 50 performs processing according to the flow shown in FIG. 8, in parallel with processing according to the flow shown in FIG. 4, thereby updating the value of the position parameter U. The processing is performed according to the flow shown in FIG. 8, values of $M_1$, $M_2$, . . . are also set.

More specifically, when the recording pass starts, the controller 50 resets all of $M_1$, $M_2$, . . . to 0 (S501), and resets the variable K to 2 (S502). Then, when a rise of the encoder signal is detected (S503: YES), if the carriage 2 moves to the left side ("one side in the scanning direction" of the present disclosure) (S504: YES), the controller 50 increases the value of the position parameter U by 1 (S505), and if the carriage 2 moves to the right side ("the other side in the scanning direction" of the present disclosure) (S504: NO), the controller 50 decreases the value of the position parameter U by 1 (S506). After the processing of S505 or S506, when the recording pass is not completed (S507: NO), the controller 50 returns to S502, and when the recording pass is completed (S507: YES), the controller 50 ends the processing.

When a rise of the encoder signal is not detected (S503: NO), if $K \times TE_N$ does not elapse since the previous rise of the encoder signal (S508: NO), the controller 50 returns to S503.

If $K \times TE_N$ elapses since the previous rise of the encoder signal (S508: YES), the controller 50 increases $M_N$ by 1 (S509). Herein, the value of N in $TE_N$ in S508 and $M_N$ in S508 is the value of N set in the processing according to the flow shown in FIG. 4.

Subsequently, when the carriage 2 moves leftward (S510: YES), the controller 50 increases the value of the position parameter U by 1 ("predetermined value" of the present disclosure) (S511), and when the carriage 2 moves rightward (S510: NO), the controller 50 decreases the value of the position parameter U by 1 (S512). After the processing of S509 or S510, the controller 50 increases the value of the variable K by 1 (S513). Then, when the recording pass is not completed (S514: NO), the controller 50 returns to S503, and when the recording pass is completed (S514: YES), the controller 50 ends the processing.

Figure 8:
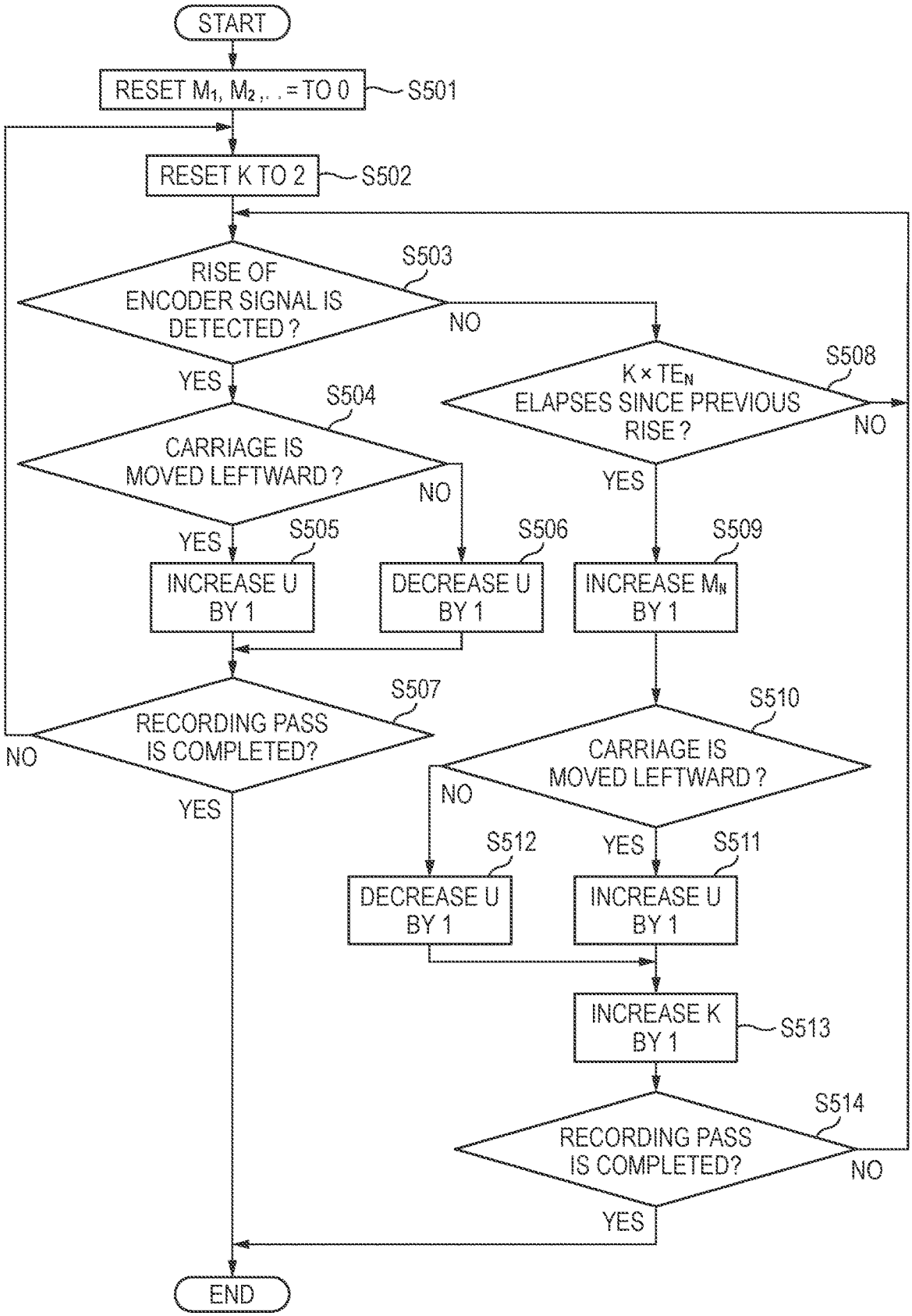
FIG. 8 is a flowchart depicting a processing flow for updating a value of a position parameter.

In the first embodiment, the processing is executed according to the flow shown in FIG. 8, as described above, so that when the carriage 2 moves to the left side in the scanning direction, the value of the position parameter U increases by 1 each time a rise of the encoder signal is detected. When a rise of an $[_{N+1}]^{th}$ encoder signal is not detected until a time of $2 \times TE_N$ elapses since the $N^{th}$ rise of the encoder signal is detected, the value of the position parameter U increases by 1. Thereafter, the value of the position parameter U increases by 1 each time a time of $TE_N$ elapses until an $[N+1]^{th}$ rise of the encoder signal is detected.

When the carriage 2 moves to the right side in the scanning direction, the value of the position parameter U decreases by 1 each time a rise of the encoder signal is detected. When a rise of the $[N+1]^{th}$ encoder signal is not detected until the time of $2 \times TE_N$ elapses since the $N^{th}$ rise of the encoder signal is detected, the value of the position parameter U decreases by 1. Thereafter, the value of the position parameter U decreases by 1 each time the time of $TE_N$ elapses until an $[N+1]^{th}$ rise of the encoder signal is detected.

In the first embodiment, when the carriage 2 moves leftward, the value of the position parameter U is increased, and when the carriage 2 moves rightward, the value of the position parameter U is decreased. However, the present invention is not limited thereto. For example, when the carriage 2 moves leftward, the value of the position parameter U may be decreased, and when the carriage 2 moves rightward, the value of the position parameter U may be increased. In this case, the right side in the scanning direction corresponds to "one side in the scanning direction" of the present disclosure, and the left side of the scanning direction corresponds to the other side in the scanning direction of the present disclosure.

The amount of increase in the position parameter U in S504 and S509 and the amount of decrease in the position parameter U in S505 and S510 may also be a predetermined value larger than or smaller than 1.

In the first embodiment, the processing is executed according to the flow shown in FIG. 8, so that when a rise of the $[N+1]^{th}$ encoder signal is not detected until the time of $2 \times TE_N$ elapses since the $N^{th}$ rise of the encoder signal is detected, the value of $M_N$ increases by 1. The value of $M_N$ increases by 1 each time the time of $TE_N$ elapses until a rise of the $[N+1]^{th}$ encoder signal is detected.

<Effects>

In the first embodiment, in a case where $TR_{N-1}$ is short, the number of multiplied signals that are generated during the $[N-1]^{th}$ detection time period becomes small, and $PR_{N-1}$ becomes smaller than $P_{N-1}$. In a case where $TR_{N-1}$ is long, the number of multiplied signals that are generated during the $[N-1]^{th}$ detection time period becomes small, and $PR_{N-1}$ becomes greater than $P_{N-1}$. Therefore, in the first embodiment, in a case where $TR_{N-1}$ is equal to or longer than TR1 and equal to or shorter than TR2, $P_N$ is calculated based on $P_N = PA_{N-1} + (P_{N-1} - PR_{N-1})$, and when a $N^{th}$ rise of the encoder signal occurs, the multiplied signals are generated every $[TE_N/P_N]$. Thereby, when the number of the multiplied signals for the $[N-1]^{th}$ detection time period becomes small, it is possible to increase the number of the multiplied signals for the $N^{th}$ detection time period. When the number of the multiplied signals for the $[N-1]^{th}$ detection time period becomes large, it is possible to decrease the number of the multiplied signals for the $N^{th}$ detection time period.

In a case where $TR_{N-1}$ is within a range of TR1 or longer and TR2 or shorter, when the multiplied signals are generated as described above, it is possible to generate the multiplied signals at appropriate time intervals. However, when $TR_{N-1}$ becomes extremely short due to influences of contaminants and the like attached to the encoder scale 18, $PR_{N-1}$ becomes extremely smaller than $P_{N-1}$ and $P_N$ that is calculated based on $P_N = PA_{N-1} + (P_{N-1} - PR_{N-1})$ becomes extremely large. For this reason, when a $N^{th}$ rise of the encoder signal occurs, if the multiplied signals are generated in a similar manner to the case where $TR_{N-1}$ is equal to or longer than TR and equal to or shorter than TR2, the time intervals of the multiplied signals become extremely short.

Therefore, in the first embodiment, when a $N^{th}$ rise of the encoder signal occurs, if $TR_{N-1}$ is shorter than TR1, the multiplied signals are generated for each time calculated as $[(2 \times TE_N - TR_{N-1})/P_N]$. Thereby, $P_N$ increases as described above. However, when $TR_{N-1}$ is short, since $[2 \times TE_N - TR_{N-1}]$ increases, the time calculated as $[(2 \times TE_N - TR_{N-1})/P_N]$ is not extremely lengthened or extremely shortened. Thereby, even when contaminants are attached to the encoder scale 18, it is possible to generate the multiplied signals at appropriate time intervals.

On the other hand, when $TR_{N-1}$ becomes extremely long due to influences of contaminants and the like attached to the encoder scale 18, $PR_{N-1}$ becomes extremely larger than $P_{N-1}$, and $P_N$ that is calculated based on $P_N = PA_{N-1} + (P_{N-1} - PR_{N-1})$ becomes extremely small. For this reason, when a $N^{th}$ rise of the encoder signal occurs, if the multiplied signals are generated in a similar manner to the case where $TR_{N-1}$ is equal to or longer than TR and equal to or shorter than TR2, the time interval of the multiplied signals becomes extremely longer.

Therefore, in the first embodiment, when a $N^{th}$ rise of the encoder signal occurs, if $TR_{N-1}$ is longer than TR2, $P_N$ is calculated based on $P_N = (M_{N-1}+1) \times PA_{N-1} + (P_{N-1} - PR_{N-1})$, and the multiplied signals are generated for each time calculated as $[(2 \times TE_N - TR_{N-1} + M_{N-1} \times C_{N-1})/P_N]$.

When $P_N$ is calculated in this way, if $PR_{N-1}$ is large, $P_N$ becomes small. $P_N$ takes into consideration the number $M_{N-1}$ of the encoder slits 18*a* that are not detected. Thereby, it is possible to reduce the number of the multiplied signals for the $N^{th}$ detection time period by the increased number of the multiplied signals for the $[N-1]^{th}$ detection time period.

In this case, although $P_N$ becomes small, as described above, when $TR_{N-1}$ is long, $[2\times TE_N-TR_{N-1}+M_{N-1}\times C_{N-1}]$ is reduced. For this reason, the time calculated as $[(2\times TE_N-TR_{N-1}+M_{N-1}\times C_{N-1})/P_N]$ is prevented from being extremely lengthened or extremely shortened. Thereby, even when contaminants are attached to the encoder scale 18, it is possible to generate the multiplied signals at appropriate time intervals.

Contaminants are attached to the encoder scale 18 in diverse forms. Therefore, in the first embodiment, as described above, in each of cases where $TR_{N-1}$ is shorter than TR1 and where $TR_{N-1}$ is longer than TR2, the multiplied signals are generated by processing different from the case where $TR_{N-1}$ is equal to or longer than TR1 and equal to or shorter than TR2. However, in this case, it may be problematic if the time interval for generating the multiplied signals is determined as described above.

Therefore, in the first embodiment, when $TR_{N-2}$ is shorter than TR1 and when $TR_{N-2}$ is longer than TR2, a value of $P_N$ is set as a value obtained by subtracting $[P_{N-2}-PR_{N-2}]$ from a value of $P_N$ when $TR_{N-2}$ is equal to or longer than TR1 and equal to or shorter than TR2. Thereby, it is possible to generate the multiplied signals at appropriate time intervals.

Figure 9A:
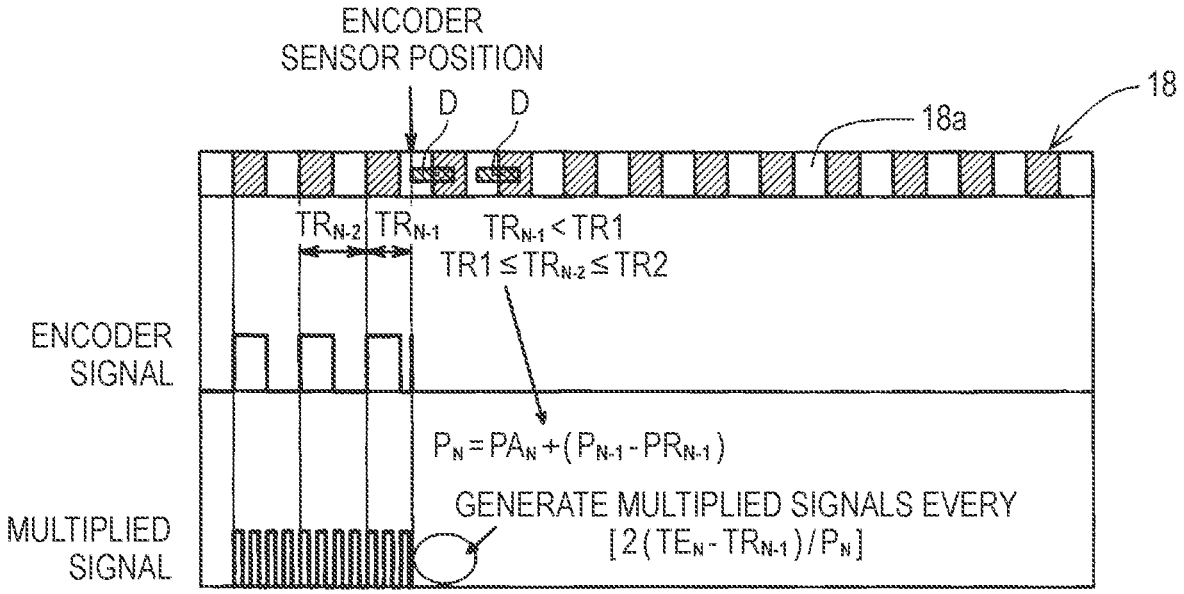
FIG. 9A illustrates generation of multiplied signals when a rise occurs in an encoder signal in a case where contaminants are attached to the encoder scale.
Figure 9B:
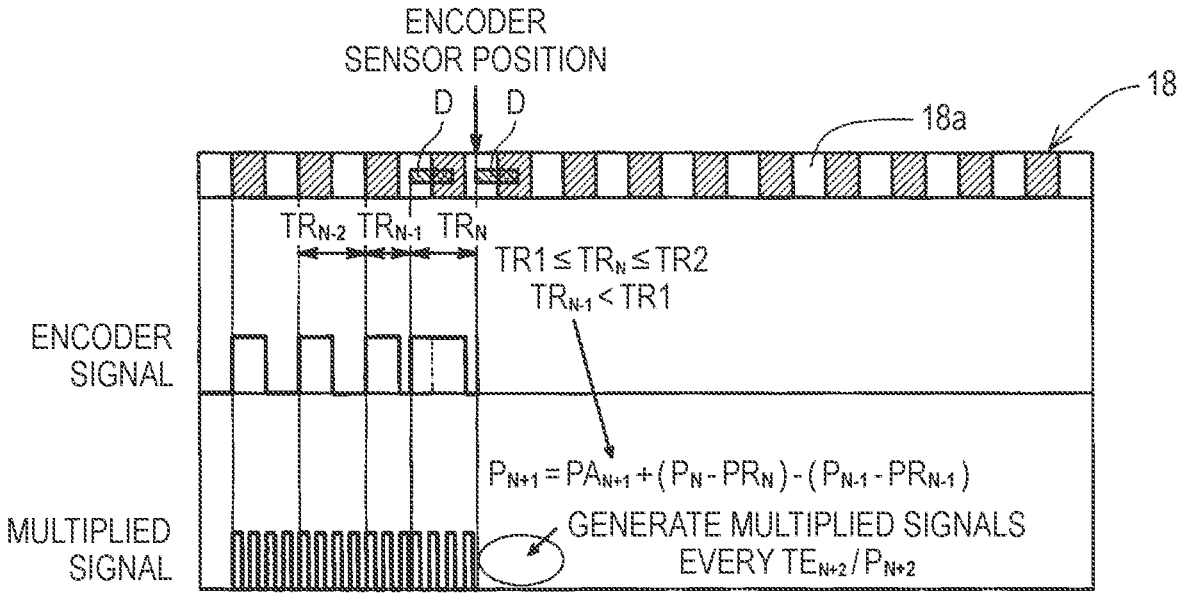
FIG. 9B illustrates generation of multiplied signals when a rise occurs in the encoder signal after FIG. 9A.
Figure 10A:
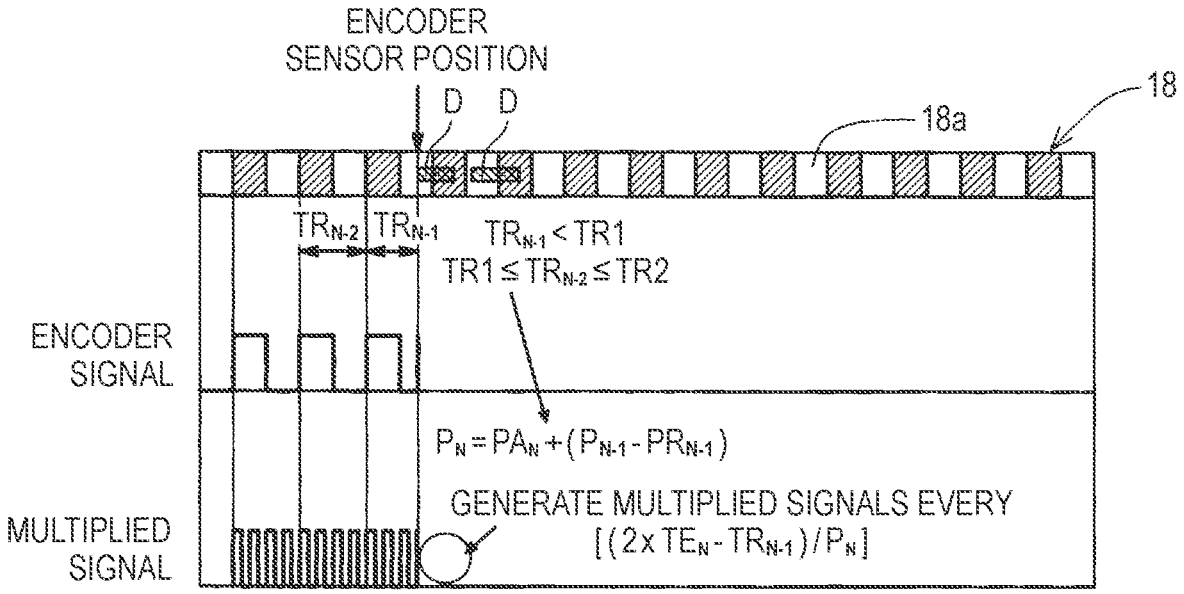
FIG. 10A is a view corresponding to FIG. 9A in a case where contaminants are attached to the encoder scale in an aspect different from FIGS. 9A and 9B.
Figure 10B:
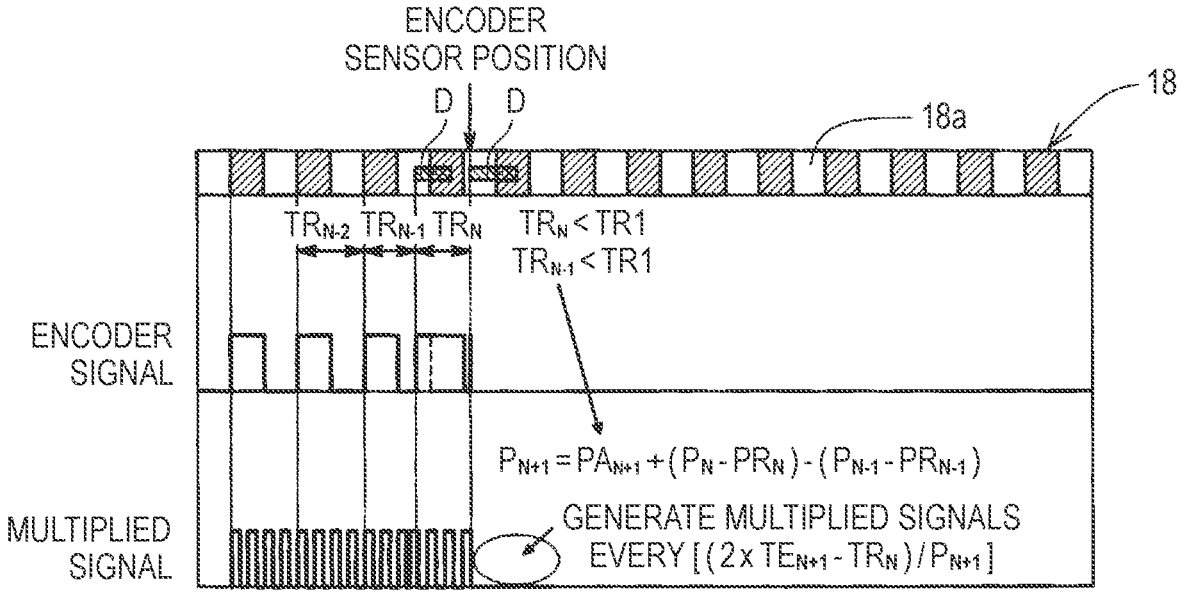
FIG. 10B is a view corresponding to FIG. 9B, in a case of FIG. 10A.
Figure 11A:
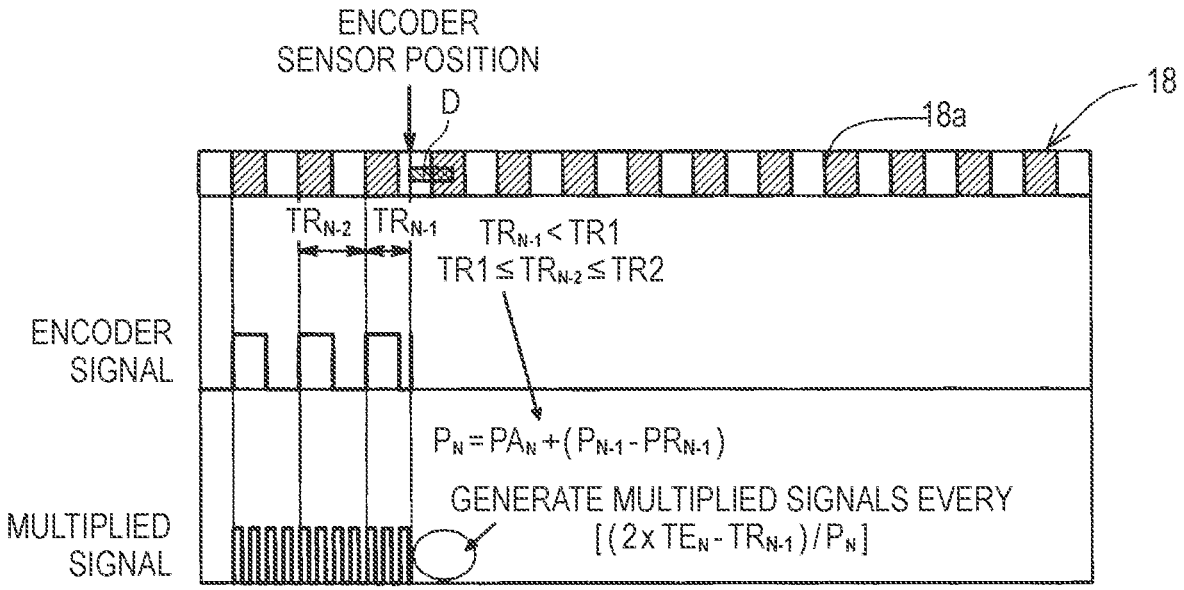
FIG. 11A is a view corresponding to FIG. 9A in a case where contaminants are attached to the encoder scale in an aspect different from FIGS. 9A to 10B.
Figure 11B:
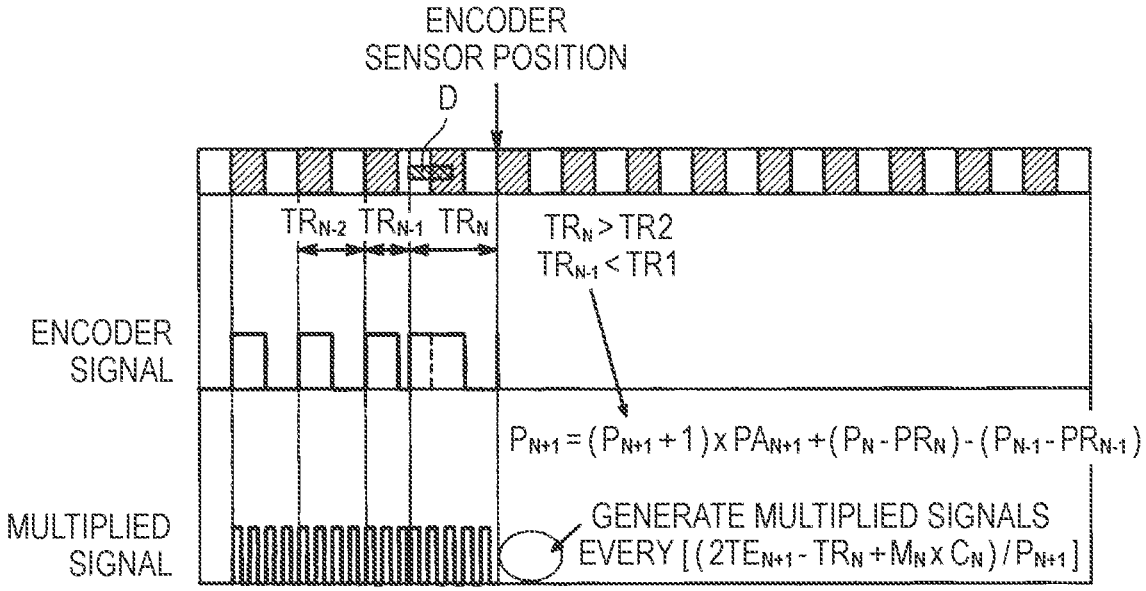
FIG. 11B is a view corresponding to FIG. 9B, in a case of FIG. 11A.

As a specific example, a case where contaminants D as shown in FIGS. 9A and 9B are attached to the encoder scale 18, a case where contaminants D as shown in FIGS. 10A and 10B are attached to the encoder scale 18 and a case where contaminants D as shown in FIGS. 11A and 11B are attached to the encoder scale 18 are considered.

In this case, when the encoder sensor 19 reaches positions shown in FIGS. 9A, 10A and 11A, a rise of the encoder signal occurs, and $TR_{N-1}$ becomes shorter than TR1. $TR_{N-2}$ is equal to or longer than TR1 and equal to or shorter than TR2.

In this case, as described above, when a $N^{th}$ rise of the encoder signal occurs, $P_N$ is calculated based on $P_N=PA_N+(P_{N-1}-PR_{N-1})$ (S302), and the multiplied signals are generated for each time calculated as $[(2\times TE_N-TR_{N-1})/P_N]$ (S305). Thereby, it is possible to generate the multiplied signals at appropriate time intervals.

On the other hand, when the encoder sensor 19 reaches a position shown in FIG. 9B, a rise of the encoder signal occurs, $TR_N$ becomes equal to or longer than TR1 and equal to or shorter than TR2. As described above, $TR_{N-1}$ is shorter than TR1. In this case, $TR_{N-1}$ is short, so that the number $PR_{N-1}$ of the multiplied signals generated during the $[N-1]^{th}$ detection time period is smaller than the target value $P_N$. For this reason, unlike the first embodiment, if $P_{N+1}$ is calculated based on $P_{N+1}=PA_{N+1}+(P_N-PR_N)$, a value of $P_{N+1}$ is affected by $[P_{N-1}-PR_{N-1}]$ (>0) and becomes large. As a result, when an $[N+1]^{th}$ rise of the encoder signal occurs, if the multiplied signals are generated every $[TE_{N+1}/P_{N+1}]$, the time interval for which the multiplied signals are generated becomes extremely short.

Therefore, in the first embodiment, in this case, when an $[N+1]^{th}$ rise of the encoder signal occurs, $P_{N+1}$ is calculated based on $P_{N+1}=PA_N+(P_N-PR_N)-(P_{N-1}-PR_{N-1})$ (S204) and the multiplied signals are generated every $[TE_{N+1}/P_{N+1}]$ (S205). Thereby, $P_{N+1}$ is not affected by $[P_{N-1}-PR_{N-1}]$, so that it is possible to generate the multiplied signals at appropriate time intervals.

When the encoder sensor 19 reaches a position shown in FIG. 10B, a rise of the encoder signal occurs and $TR_N$ becomes shorter than TR1. As described above, $TR_{N-1}$ is shorter than TR1. In this case, $TR_{N-1}$ is short, so that the number $PR_{N-1}$ of the multiplied signals generated during the $[N-1]^{th}$ detection time period is smaller than the target value $P_{N-1}$. For this reason, unlike the first embodiment, if $P_{N+1}$ is calculated based on $P_{N+1}=PA_{N+1}+(P_N-PR_N)$, a value of $P_{N+1}$ is affected by $[P_{N-1}-PR_{N-1}]$ (>0) and becomes large. In the meantime, a value of $(2\times TE_{N+1}-TR_N)$ is determined by a value of $TR_N$, irrespective of a value of $TR_{N-1}$. As a result, when an $[N+1]^{th}$ rise of the encoder signal occurs, if the multiplied signals are generated every $[(2\times TE_N+-TR_N)/P_{N+1}]$, the time interval for which the multiplied signals are generated becomes extremely short.

Therefore, in the first embodiment, in this case, when an $[N+1]^{th}$ rise of the encoder signal occurs, $P_{N+1}$ is calculated based on $P_{N+1}=PA_{N+1}+(P_N-PR_N)-(P_{N-1}-PR_{N-1})$ (S304) and the multiplied signals are generated every $[(2\times TE_{N+1}-TR_N)/P_{N+1}]$ (S305). Thereby, $P_{N+1}$ is not affected by $[P_{N-1}-PR_{N-1}]$, so that it is possible to generate the multiplied signals at appropriate time intervals.

When the encoder sensor 19 reaches a position shown in FIG. 11B, a rise of the encoder signal occurs and $TR_N$ becomes longer than TR2. As described above, $TR_{N-1}$ is shorter than TR1. In this case, $TR_{N-1}$ is short, so that the number $PR_{N-1}$ of the multiplied signals generated during the $[N-1]^{th}$ detection time period is smaller than the target value $P_{N-1}$. For this reason, unlike the first embodiment, if $P_{N+1}$ is calculated based on $P_{N+1}=(M_{N+1})\times PA_{N+1}+(P_N-PR_N)$, $P_{N+1}$ is affected by $[P_{N-1}-PR_{N-1}]$ (>0) and becomes large. In the meantime, a value of $[2\times TE_N-TR_N+M_N\times C_N]$ is determined by a value of $TR_N$, irrespective of a value of $TR_{N-1}$. As a result, when an $[N+1]^{th}$ rise of the encoder signal occurs, if the multiplied signals are generated every $[(2\times TE_{N+1}-TR_N+M_N\times C_N)/P_{N+1}]$, the time interval for which the multiplied signals are generated becomes extremely short.

Therefore, in the first embodiment, in this case, when an $[N+1]^{th}$ rise of the encoder signal occurs, $P_{N+1}$ is calculated based on $P_{N+1}=(M_{N+1})\times PA_{N+1}+(P_N-PR_N)-(P_{N-1}-PR_{N-1})$ (S404) and the multiplied signals are generated every $[(2\times TE_{N+1}-TR_N+M_N\times C_N)/P_{N+1}]$ (S405). Thereby, $P_{N+1}$ is not affected by $[P_{N-1}-PR_{N-1}]$, so that it is possible to generate the multiplied signals at appropriate time intervals.

Figure 12A:
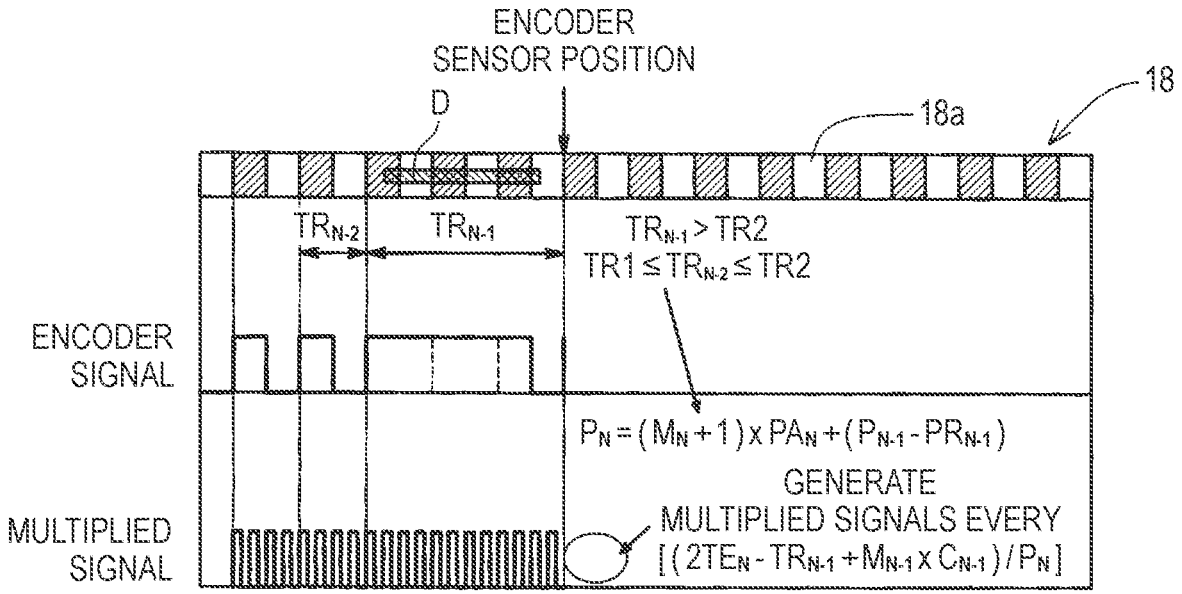
FIG. 12A is a view corresponding to FIG. 9A in a case where contaminants are attached to the encoder scale in an aspect different from FIGS. 9A to 11B.
Figure 12B:
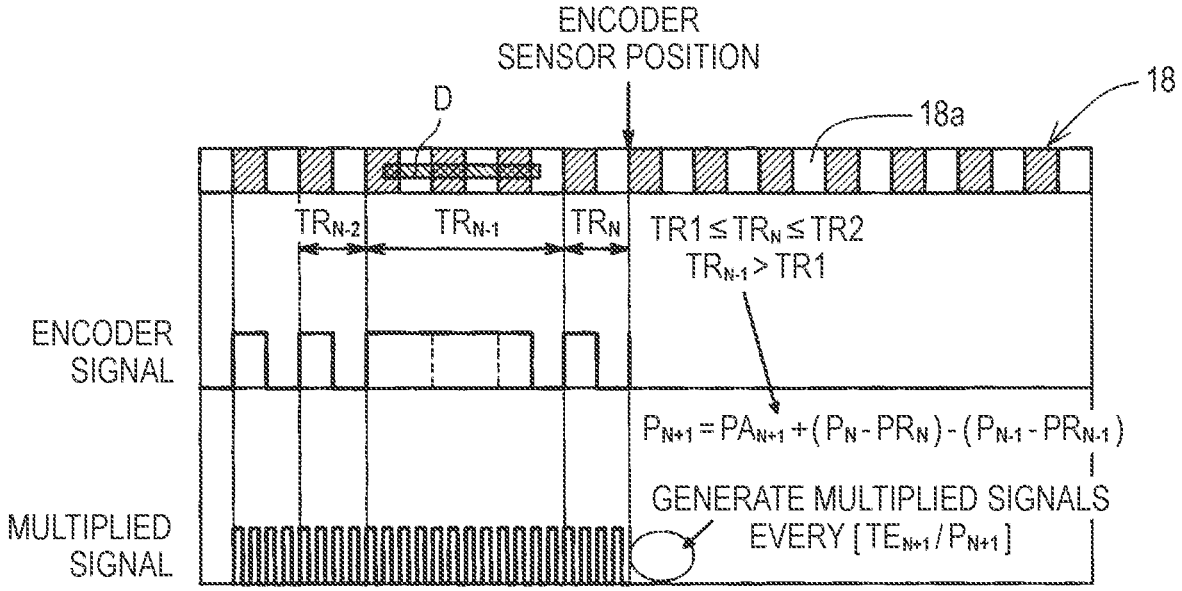
FIG. 12B is a view corresponding to FIG. 9B, in a case of FIG. 12A.
Figure 13A:
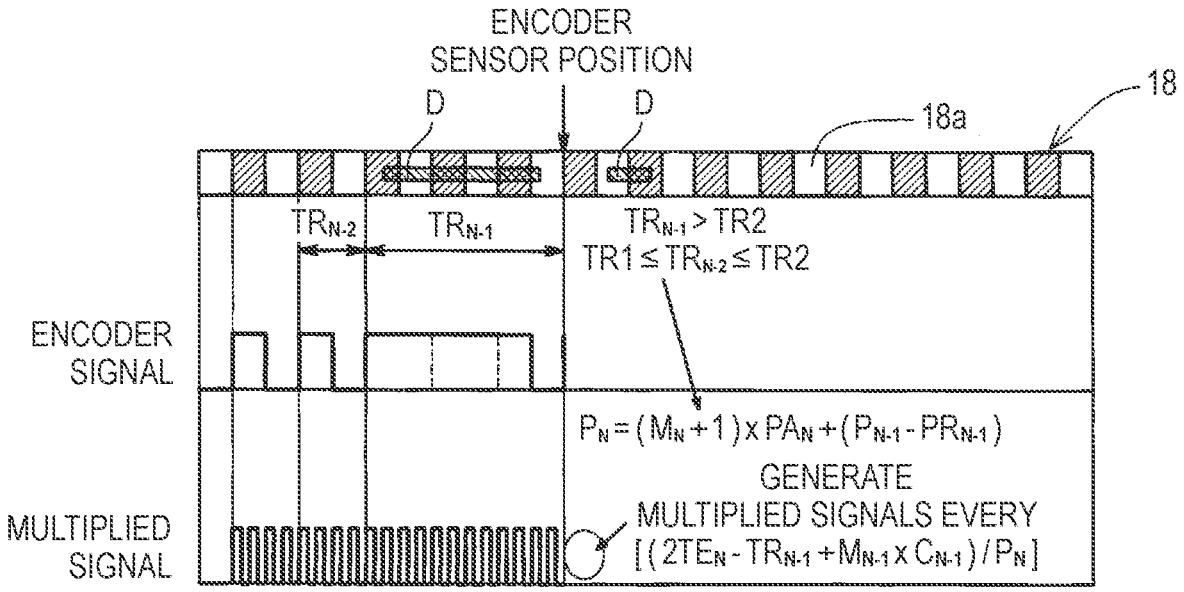
FIG. 13A is a view corresponding to FIG. 9A in a case where contaminants are attached to the encoder scale in an aspect different from FIGS. 9A to 12B.
Figure 13B:
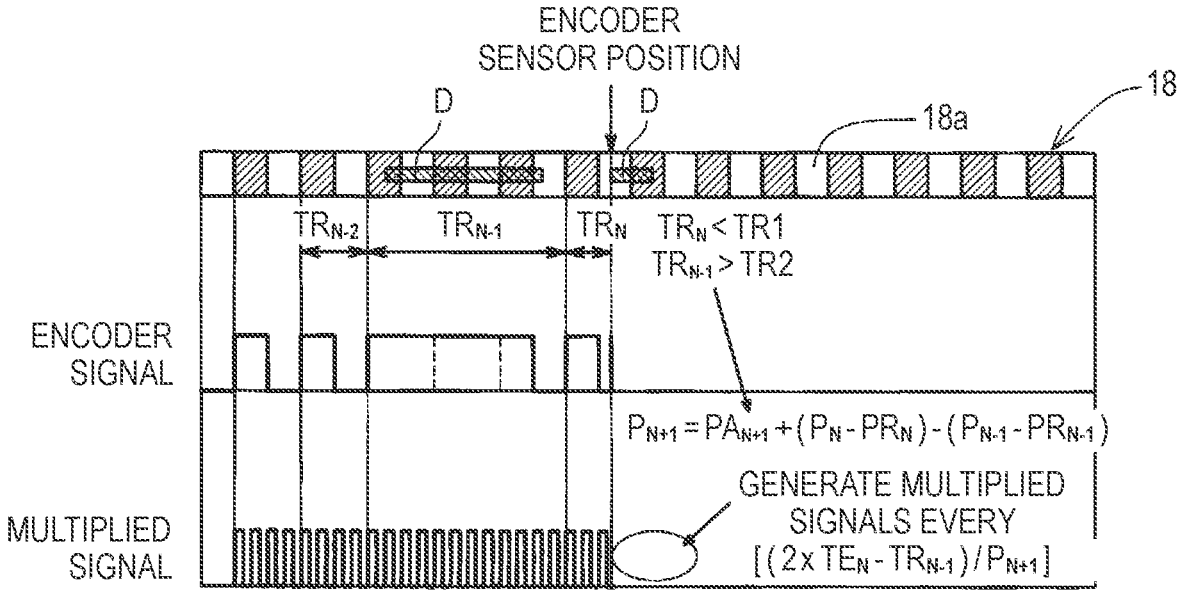
FIG. 13B is a view corresponding to FIG. 9B, in a case of FIG. 13A.
Figure 14A:
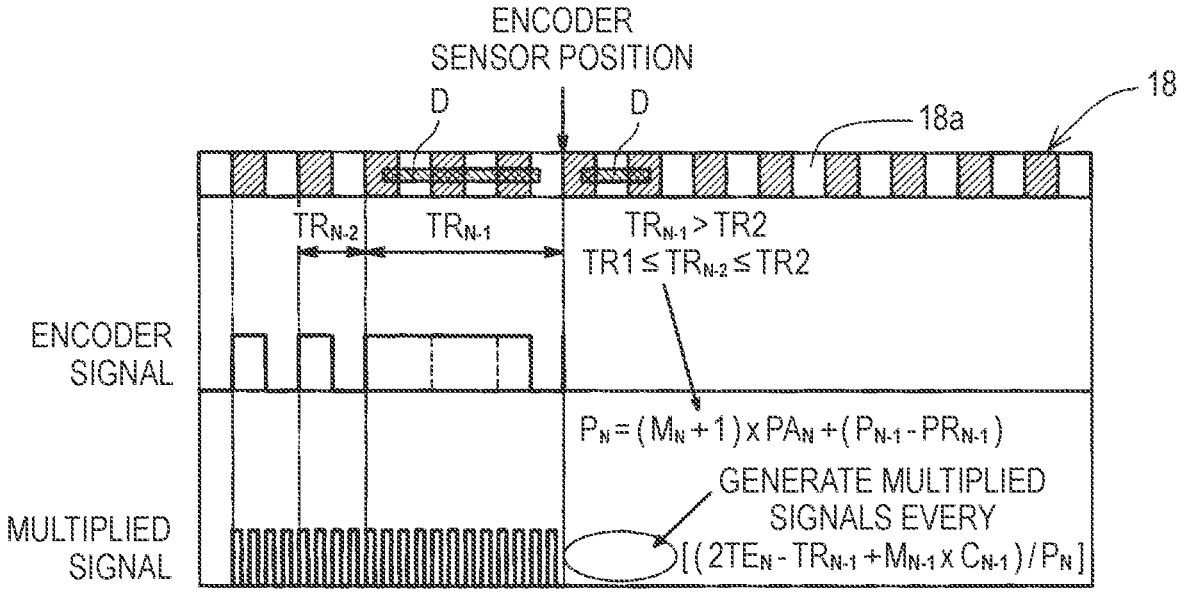
FIG. 14A is a view corresponding to FIG. 9A in a case where contaminants are attached to the encoder scale in an aspect different from FIGS. 9A to 13B.
Figure 14B:
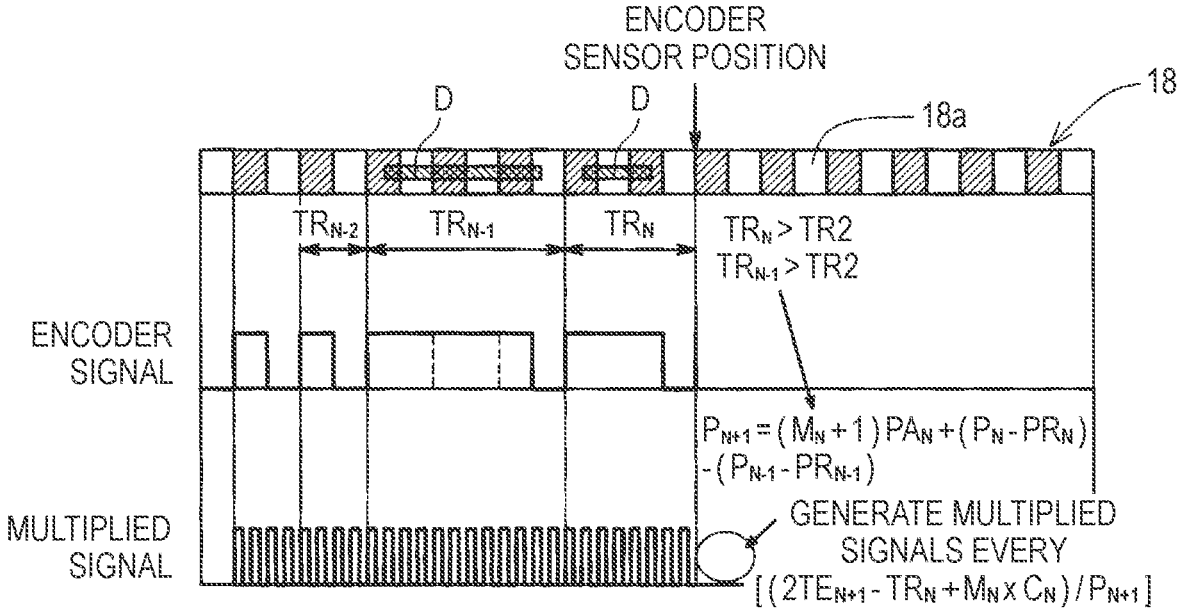
FIG. 14B is a view corresponding to FIG. 9B, in a case of FIG. 14A.

For example, a case where contaminants D as shown in FIGS. 12A and 12B are attached to the encoder scale 18, a case where contaminants D as shown in FIGS. 13A and 13B are attached to the encoder scale 18 and a case where contaminants D as shown in FIGS. 14A and 14B are attached to the encoder scale 18 are considered.

In this case, when the encoder sensor 19 reaches positions shown in FIGS. 12A, 13A and 14A, a rise of the encoder signal occurs, and $TR_{N-1}$ becomes longer than TR2. $TR_{N-2}$ is equal to or longer than TR1 and equal to or shorter than TR2.

In this case, as described above, when a $N^{th}$ rise of the encoder signal occurs, $P_N$ is calculated based on $P_N=(M_{N-1}+1)\times PA_N+(P_{N-1}-PR_{N-1})$ (S402), and the multiplied signals are generated for each time calculated as $[(2\times TE_N-TR_N-+M_{N-1}\times C_{N-1})/P_N]$ (S405). Thereby, it is possible to generate the multiplied signals at appropriate time intervals.

On the other hand, when the encoder sensor 19 reaches a position shown in FIG. 12B, a rise of the encoder signal occurs, and $TR_N$ becomes equal to or longer than TR1 and equal to or shorter than TR2. As described above, $TR_{N-1}$ is longer than TR2. In this case, $TR_{N-1}$ is long, so that the number $PR_{N-1}$ of the multiplied signals generated during the $[N-1]^{th}$ detection time period is larger than the target value $P_N$. For this reason, unlike the first embodiment, if $P_{N+1}$ is calculated based on $P_{N+1}=PA_N+(P_N-PR_N)$, a value of $P_{N+1}$ is affected by $[P_{N-1}-PR_{N-1}]$ (<0) and becomes small. As a result, when an $[N+1]^{th}$ rise of the encoder signal occurs, if the multiplied signals are generated every $[TE_{N+1}/P_{N+1}]$, the time interval for which the multiplied signals are generated becomes extremely long.

Therefore, in the first embodiment, in this case, when an $[N+1]^{th}$ rise of the encoder signal occurs, $P_{N+1}$ is calculated based on $P_{N+1}=PA_N+(P_N-PR_N)-(P_{N-1}-PR_{N-1})$ (S204) and the multiplied signals are generated every $[TE_{N+1}/P_{N+1}]$ (S205). Thereby, $P_{N+1}$ is not affected by $[P_{N-1}-PR_{N-1}]$, so that it is possible to generate the multiplied signals at appropriate time intervals.

When the encoder sensor 19 reaches a position shown in FIG. 13B, a rise of the encoder signal occurs and $TR_N$ becomes shorter than TR1. As described above, $TR_{N-1}$ is longer than TR2. In this case, $TR_{N-1}$ is long, so that the number $PR_{N-1}$ of the multiplied signals generated during the $[N-1]^{th}$ detection time period is larger than the target value $P_{N-1}$. For this reason, unlike the first embodiment, if $P_{N+1}$ is calculated based on $P_{N+1}=PA_N+(P_N-PR_N)$, a value of $P_{N+1}$ is affected by $[P_{N-1}-PR_{N-1}]$ (<0) and becomes small. In the meantime, a value of $(2\times TE_{N+1}-TR_N)$ is determined by a value of $TR_N$, irrespective of a value of $TR_{N-1}$. As a result, when an $[N+1]^{th}$ rise of the encoder signal occurs, if the multiplied signals are generated every $[(2\times TE_N+-TR_N)/P_{N+1}]$, the time interval for which the multiplied signals are generated becomes extremely long.

Therefore, in the first embodiment, in this case, when an $[N+1]^{th}$ rise of the encoder signal occurs, $P_{N+1}$ is calculated based on $P_{N+1}=PA_N+(P_N-PR_N)-(P_{N-1}-PR_{N-1})$ (S304) and the multiplied signals are generated every $[(2\times TE_{N+1}-TR_N)/P_{N+1}]$ (S305). Thereby, $P_{N+1}$ is not affected by $[P_{N-1}-PR_{N-1}]$, so that it is possible to generate the multiplied signals at appropriate time intervals.

When the encoder sensor 19 reaches a position shown in FIG. 14B, a rise of the encoder signal occurs and $TR_N$ becomes longer than TR2. As described above, $TR_{N-1}$ is longer than TR2. In this case, $TR_{N-1}$ is long, so that the number $PR_{N-1}$ of the multiplied signals generated during the $[N-1]^{th}$ detection time period is larger than the target value $P_{N-1}$. For this reason, unlike the first embodiment, if $P_{N+1}$ is calculated based on $P_{N+1}=(M_{N+1})\times PA_{N+1}+(P_N-PR_N)$, a value of $P_{N+1}$ is affected by $[P_{N-1}-PR_{N-1}]$ (<0) and becomes small. In the meantime, a value of $[2\times TE_N+-TR_N+M_N\times C_N]$ is determined by a value of $TR_N$, irrespective of a value of $TR_{N-1}$. As a result, when an $[N+1]^{th}$ rise of the encoder signal occurs, if the multiplied signals are generated every $[(2\times TE_{N+1}-TR_N+M_N\times C_N)/P_{N+1}]$, the time interval for which the multiplied signals are generated becomes extremely long.

Therefore, in the first embodiment, in this case, when an $[N+1]^{th}$ rise of the encoder signal occurs, $P_{N+1}$ is calculated based on $P_{N+1}=(M_{N+1})\times PA_{N+1}+(P_N-PR_N)-(P_{N-1}-PR_{N-1})$ (S404) and the multiplied signals are generated every $[(2\times TE_{N+1}-TR_N+M_N\times C_N)/P_{N+1}]$ (S405). Thereby, $P_{N+1}$ is not affected by $[P_{N-1}-PR_{N-1}]$, so that it is possible to generate the multiplied signals at appropriate time intervals.

In this way, in the first embodiment, when $TR_{N-2}$ is shorter than TR1 and when $TR_{N-2}$ is longer than TR2, the value of $P_N$ is set as a value obtained by subtracting $[P_{N-1}-PR_{N-1}]$ from a value of $P_N$ when $TR_{N-2}$ is equal to or longer than TR1 and equal to or shorter than TR2, so that it is possible to generate the multiplied signals at appropriate time intervals.

In the first embodiment, a value of $C_{N-1}$ is calculated as an average value of lengths of the past detection time periods before the $N^{th}$ detection time period. Thereby, the calculated time interval of the multiplied signals can be made appropriate.

In the first embodiment, when a rise of the encoder signal is detected, the value of the position parameter U is increased or decreased according to the moving direction of the carriage 2. When the time of $2\times TE_N$ elapses from the $N^{th}$ rise of the encoder signal without an $[N+1]^{th}$ rise of the encoder signal, the value of the position parameter U is also increased or decreased according to the moving direction of the carriage 2. Thereafter, the position parameter U is increased or decreased each time the time of $TE_N$ elapses until an $[N+1]^{th}$ rise of the encoder signal occurs, according to the moving direction of the carriage 2. Thereby, the value of the position parameter U accurately corresponds to the position of the carriage 2 in the scanning direction, taking into consideration the encoder slits 18*a* that are not detected due the influences of contaminants and the like attached to the encoder scale 18. Thereby, it is possible to accurately acquire the position information of the carriage 2 in the scanning direction, based on the value of the position parameter U.

Second Embodiment

A second embodiment of the present disclosure is described.

<Schematic Configuration of Printer>

Figure 15:
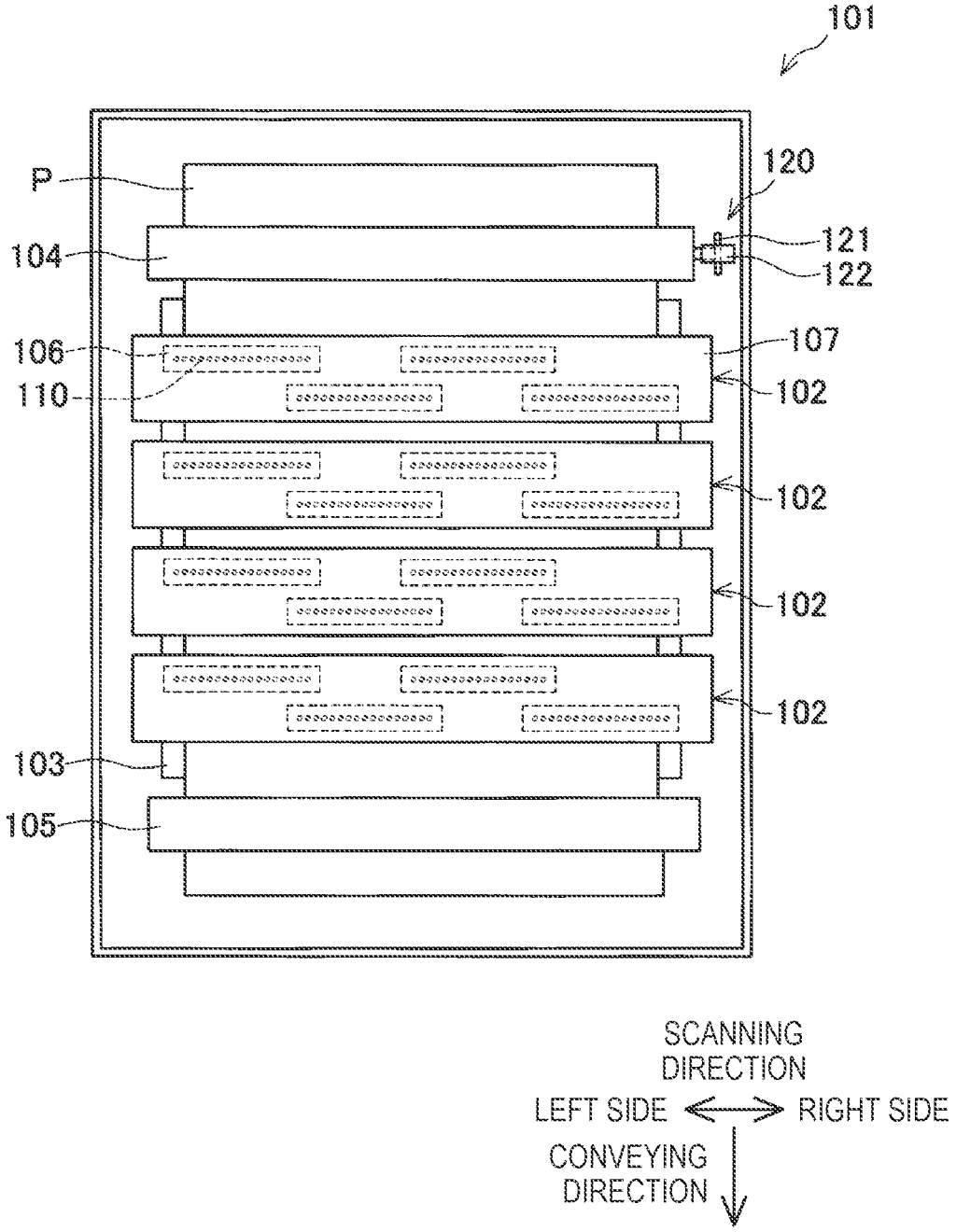
FIG. 15 is a schematic configuration view of a printer in accordance with a second embodiment.

As shown in FIG. 15, a printer 101 of the second embodiment ("liquid discharge apparatus" of the present disclosure) includes four inkjet heads 102 (liquid discharge head" of the present disclosure), a platen 103, conveyor rollers 104 and 105 ("conveyor" of the present disclosure), and the like.

The four inkjet heads 102 are disposed side by side in the conveying direction. Each of the inkjet heads 102 includes four head units 106, and a head holding member 107.

The head unit 106 has a plurality of nozzles 110 aligned at equal intervals in the scanning direction. The four head units 106 of the inkjet head 102 are aligned in two rows in the scanning direction, and some nozzles 110 of the head units 106 configuring a row on an upstream side with respect to the conveying direction and some nozzles 110 of the head units 106 configuring a row on a downstream side with respect to the conveying direction are overlapped in the conveying direction. Thereby, in the inkjet head 102, the plurality of nozzles 110 of the four head units 106 are aligned in the scanning direction over an entire length of the recording sheet P. That is, the inkjet head 102 is a line head.

The head holding member 107 is a plate-shaped member having a length direction in the scanning direction, and is configured to hold the four head units 106.

The four inkjet heads 102 are configured to discharge black, yellow, cyan and magenta inks from the plurality of nozzles 110, from those disposed on the upstream side with respect to the conveying direction. The head units 106 of the four inkjet heads 102 are supplied with inks of corresponding colors from ink cartridges (not shown).

The platen 103 is disposed below the four inkjet heads 102, extends over the entire length of the recording sheet P in the scanning direction, and extends over the four inkjet heads 102 in the conveying direction.

The conveyor roller 104 is disposed upstream of the four inkjet heads 102 with respect to the conveying direction. The conveyor roller 105 is disposed downstream of the four inkjet heads 102 with respect to the conveying direction. The conveyor rollers 104 and 105 are connected to a conveyor motor 156 via a gear and the like (not shown). When the conveyor motor 156 is driven, the conveyor rollers 104 and 105 are rotated to convey the recording sheet P in the conveying direction.

As shown in FIG. 15, in the printer 101 of the second embodiment, the conveyor roller 104 is provided with a rotary encoder 120. Note that, the rotary encoder 120 may also be provided to the conveyor roller 105.

Figure 16A:
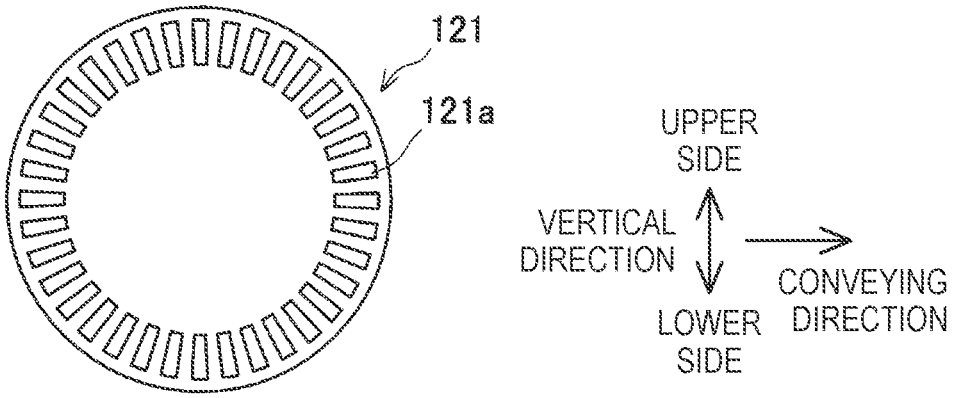
FIG. 16A depicts an encoder disk shown in FIG. 1, as seen from the scanning direction.

The rotary encoder 120 includes an encoder disk 121 ("slit member" of the present disclosure), and an encoder sensor 122. As shown in FIG. 16A, the encoder disk 121 is a circular plate-shaped member. The encoder disk 121 is attached to the conveyor roller 104, and is configured to rotate together with the conveyor roller 104. The encoder disk 121 has also a plurality of encoder slits 121*a*. The plurality of encoder slits 121*a* has translucency, and is aligned at equal intervals in a circumferential direction ("predetermined direction" of the present disclosure) of the encoder disk 121.

Figure 16B:
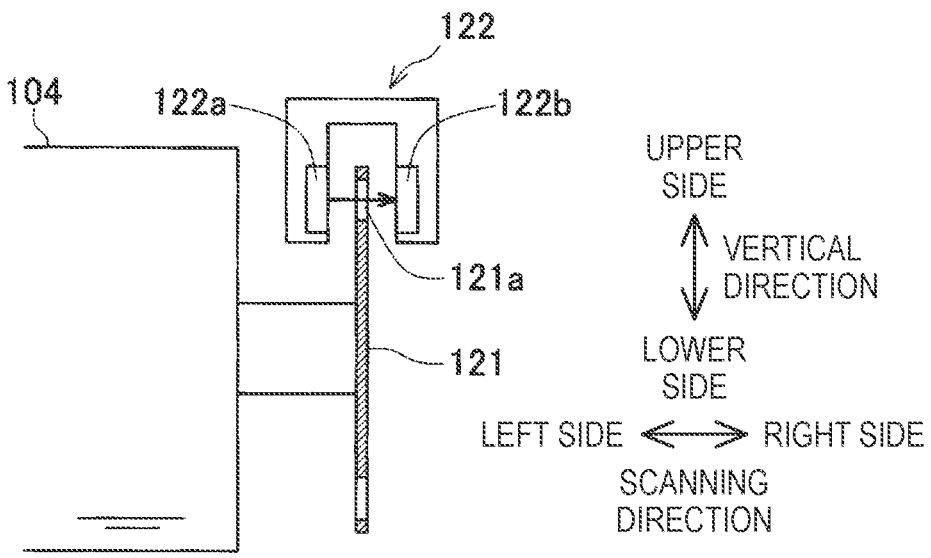
FIG. 16B depicts the encoder disk and the encoder sensor in a state where the encoder sensor faces an encoder slit of the encoder disk, as seen from a downstream side with respect to the conveying direction.
Figure 16C:
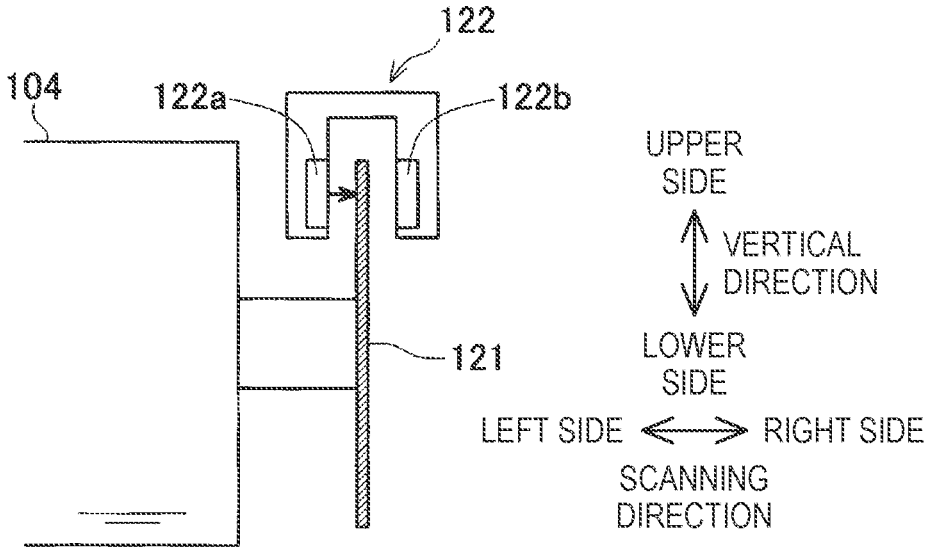
FIG. 16C depicts the encoder disk and the encoder sensor in a state where the encoder sensor does not face the encoder slit of the encoder disk, as seen from the downstream side with respect to the conveying direction.

As shown in FIGS. 16B and 16C, the encoder sensor 122 includes a light-emitting element 122*a* and a light-receiving element 122*b*. The light-emitting element 122*a* and the light-receiving element 122*b* are disposed facing each other in the scanning direction. The encoder disk 121 is disposed between the light-emitting element 122*a* and the light-receiving element 122*b* in the scanning direction, and the light-emitting element 122*a* and the light-receiving element 122*b* face each other with the encoder disk 121 being sandwiched therebetween. The light-emitting element 122*a* is configured to irradiate light toward the light-receiving element 122*b*.

In a state where the encoder sensor 19 (the light-emitting element 122*a* and the light-receiving element 122*b*) faces the encoder slit 121*a* of the encoder disk 121, the light irradiated from the light-emitting element 122*a* passes through the translucent encoder slit 121*a* and is then received in the light-receiving element 122*b*, as shown in FIG. 16B. On the other hand, in a state where the encoder sensor 122 (the light-emitting element 122*a* and the light-receiving element 122*b*) faces a part between the two adjacent encoder slits 121*a* of the encoder disk 121, the light irradiated from the light-emitting element 122*a* is blocked by the encoder disk 121 and is not thus received in the light-receiving element 122*b*, as shown in FIG. 16C.

The encoder sensor 122 is configured to output a signal indicating whether the light from the light-emitting element 122*a* is received in the light-receiving element 122*b*. More specifically, the encoder sensor 122 is configured to transmit an encoder signal that is a pulse signal that rises when a state is switched from a state in which the light irradiated from the light-emitting element 122*a* is received in the light-receiving element 122*b* to a state in which the light is not received in the light-receiving element 122*b* and falls when a state in switched from the state in which the light irradiated from the light-emitting element 122*a* is not received in the light-receiving element 122*b* to the state in which the light is received in the light-receiving element 122*b*.

<Electrical Configuration of Printer>

Figure 17:
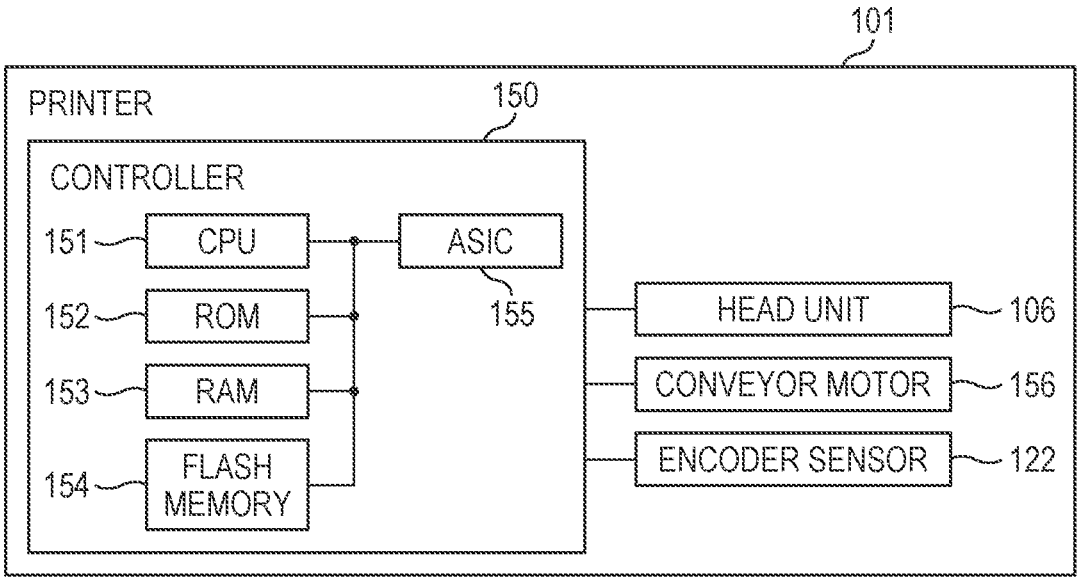
FIG. 17 is a block diagram depicting an electric configuration of the printer in accordance with the second embodiment.
Figure 18:
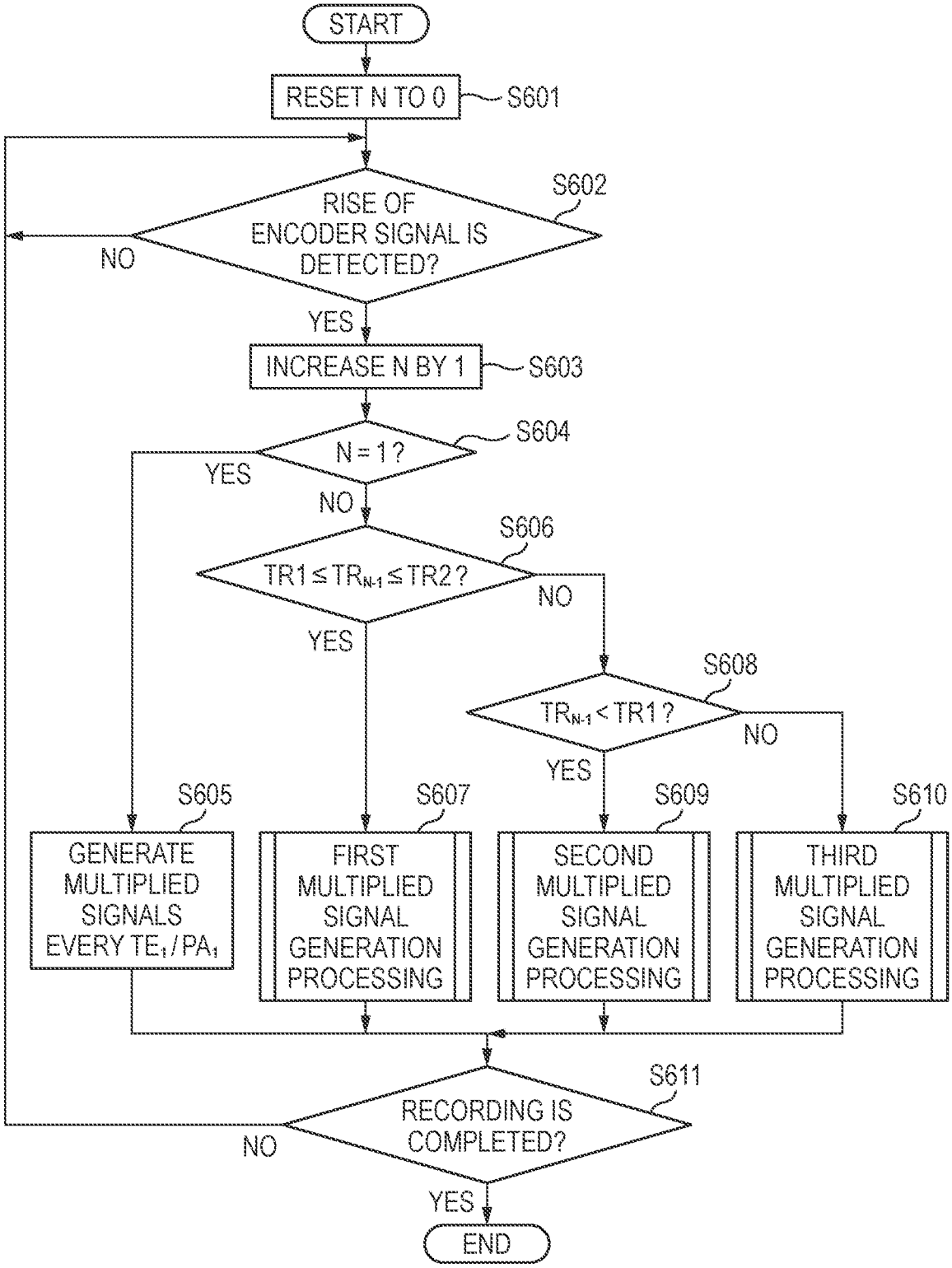
FIG. 18 is a flowchart depicting a processing flow for generating multiplied signals in the second embodiment.

Subsequently, an electrical configuration of the printer 101 is described. Operations of the printer 101 are controlled by a controller 150. As shown in FIG. 17, the controller 150 includes a CPU 151, a ROM 152, a RAM 153, a flash memory 154, an ASIC 155 and the like, and is configured to control operations of the head unit 106, the conveyor motor 156 and the like. The controller 150 is also configured to receive the encoder signal transmitted from the encoder sensor 122. In the second embodiment, the printer 101 includes the plurality of head units 106. However, in FIG. 17, for convenience of sake, only one head unit 106 is shown.

Note that, the controller 150 may also be configured so that only the CPU 151 executes a variety of processing, only the ASIC 155 executes a variety of processing, or the CPU 151 and the ASIC 155 execute a variety of processing in cooperation with each other. The controller 150 may also be configured so that one CPU 151 solely executes processing or a plurality of CPUs 151 shares and executes processing. The controller 150 may also be configured so that one ASIC 155 solely executes processing or a plurality of ASICs 155 shares and executes processing.

<Processing Upon Recording>

Subsequently, control that is executed when performing recording on the recording sheet P in the printer 101 is described. In the printer 101, the controller 150 causes the plurality of head units 106 to discharge inks from the plurality of nozzles 110 while controlling the conveyor motor 156 to cause the conveyor rollers 104 and 105 to convey the recording sheet P in the conveying direction, thereby performing recording on the recording sheet P.

<Generation of Multiplied Signal>

When performing recording on the recording sheet P, as described above, the encoder disk 121 is rotated together with the conveyor roller 104, so that the encoder sensor 122 and the encoder disk 121 relatively move in the circumferential direction of the encoder disk 121 and the encoder signal as described above is output from the encoder sensor 122.

When performing recording on the recording sheet P, the controller 150 generates multiplied signals by multiplying the encoder signal received from the encoder sensor 122. Then, the controller 150 causes the head units 106 to discharge the inks from the plurality of nozzles 110 at a timing at which a rise occurs in the generated multiplied signal, for example. In the below, the generation of the multiplied signals is described.

In the second embodiment, when the recording on the recording sheet P starts, the controller 150 executes processing according to a flow shown in FIG. 8, thereby generating the multiplied signal.

More specifically, when the recording on the recording sheet P starts, the controller 150 executes processing from S601 to S610 similar to S101 to S110 of the first embodiment. In S102 of the first embodiment, it is determined whether a rise of the encoder signal from the linear encoder 8 is detected. However, in S602 of the second embodiment, it is determined whether a rise of the encoder signal from the rotary encoder 120 is detected.

Then, after executing processing of any one of S605, S607, S609 and S610, the controller 150 determines whether the recording on the recording sheet P is completed (S611). When it is determined that the recording on the recording sheet P is not completed (S611: NO), the controller 150 returns to S602, and when it is determined that the recording on the recording sheet P is completed (S611: YES), the controller 150 ends the processing.

<Effects>

In the second embodiment also, similar to the first embodiment, in a case where $TR_{N-1}$ is equal to or longer than TR1 and equal to or shorter than TR2, $P_N$ is calculated based on $P_N=PA_{N-1}+(P_{N-1}-PR_{N-1})$, and the multiplied signals are generated every $[TE_N/P_N]$ when a $N^{th}$ rise of the encoder signal occurs. Thereby, when the number of the multiplied signals for the $[N-1]^{th}$ detection time period becomes small, the number of the multiplied signals for the $N^{th}$ detection time period can be increased. When the number of the multiplied signals for the $[N-1]^{th}$ detection time period becomes large, the number of the multiplied signals for the $N^{th}$ detection time period can be reduced.

In the second embodiment also, similar to the first embodiment, in a case where $TR_{N-1}$ is shorter than TR1, the multiplied signals are generated for each time calculated as $[(2\times TE_N-TR_{N-1})/P_N]$ when a $N^{th}$ rise of the encoder signal occurs. Thereby, even when contaminants are attached to the encoder scale 18, it is possible to generate the multiplied signals at appropriate time intervals.

In the second embodiment also, similar to the first embodiment, in a case where $TR_{N-1}$ is longer than TR2, $P_N$ is calculated based on $P_N=(M_{N-1}+1)\times PA_{N-1}+(P_{N-1}-PR_{N-1})$ and the multiplied signals are generated for each time calculated as $[(2\times TE_N-TR_{N-1}+M\times C_{N-1})/P_N]$. Thereby, even when contaminants are attached to the encoder slits, it is possible to generate the multiplied signals at appropriate time intervals.

In the second embodiment also, in each of cases where $TR_{N-1}$ is shorter than TR1 and where $TR_{N-1}$ is longer than TR2, the processing for determining the time interval for generating the multiplied signals is made different from the case where $TR_{N-1}$ is equal to or longer than TR1 and equal to or shorter than TR2. However, in this case, it may be problematic if the time interval for generating the multiplied signals is determined as described above.

Therefore, also in the second embodiment, similar to the first embodiment, when $TR_{N-2}$ is shorter than TR1 and when $TR_{N-2}$ is longer than TR2, a value of $P_N$ is set as a value obtained by subtracting $[P_{N-1}-PR_{N-1}]$ from a value of $P_N$ when $TR_{N-2}$ is equal to or longer than TR1 and equal to or shorter than TR2. Thereby, it is possible to generate the multiplied signals at appropriate time intervals.

Modified Embodiments

In the above, the first and second embodiments of the present disclosure have been described. However, the present invention is not limited to the first and second embodiments and can be diversely modified within the scope of the claims.

For example, in the first and second embodiments, as the value of $C_{N-1}$ that is a standard value of the length of the $[N-1]^{th}$ detection time period, the average value of lengths of the predetermined number of times of past detection time periods before the $N^{th}$ detection time period is used. However, the present invention is not limited thereto.

Figure 19A:
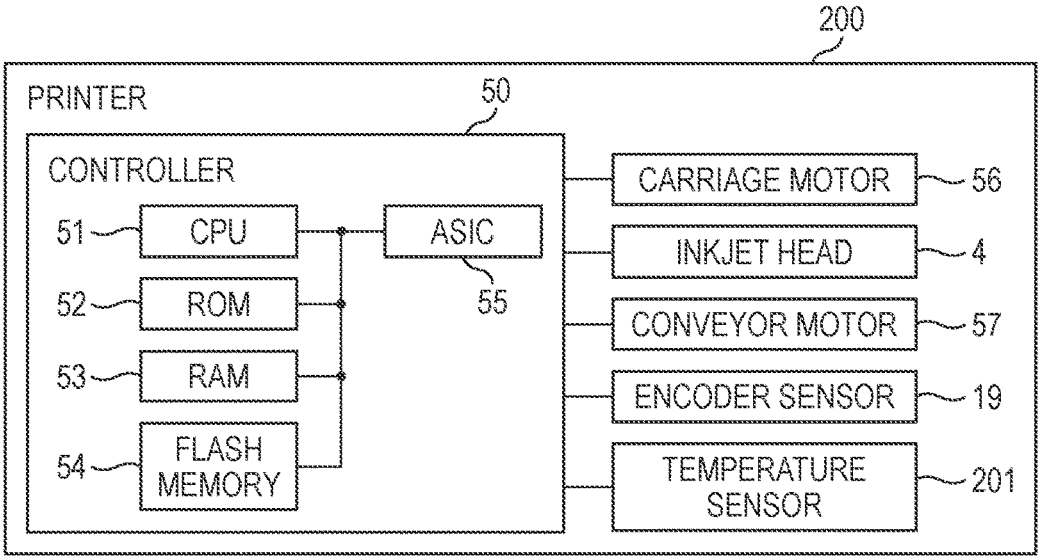
FIG. 19A is a block diagram depicting an electric configuration of a printer in accordance with a modified embodiment 1.

In a modified embodiment 1, as shown in FIG. 19A, a printer 200 includes a temperature sensor 201 for detecting a temperature, in addition to a configuration similar to the printer 1 of the first embodiment. The temperature sensor 201 is mounted to the carriage 2, for example.

Figure 19B:
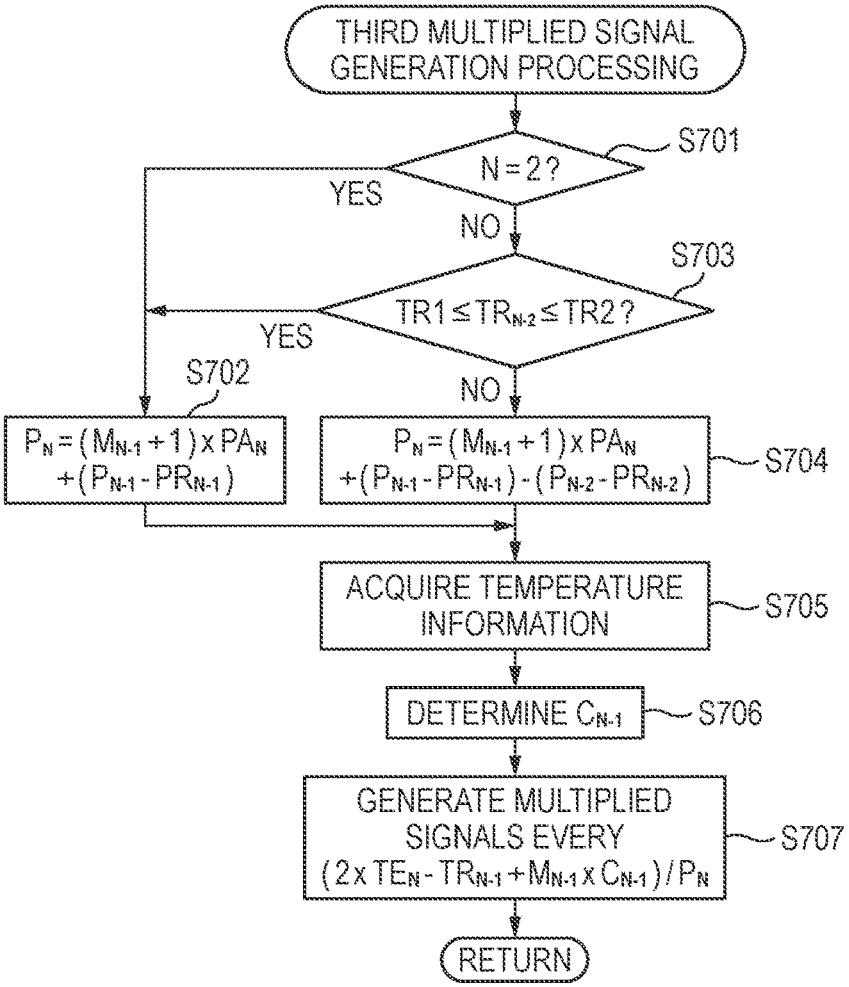
FIG. 19B is a flowchart depicting a flow of third multiplied signal generation processing in the modified embodiment 1.

In the modified embodiment 1, as shown in FIG. 19B, in the third multiplied signal generation processing, the controller 50 executes processing of S701 to S704 similar to S401 to S404 of the first embodiment. Then, after calculating $P_N$ in processing of S702 or S704, the controller 50 acquires temperature information, based on a signal from the temperature sensor 201 (S705). Then, the controller 50 determines a value of $C_{N-1}$, based on the acquired temperature information (S706), and executes processing of S707 similar to S406 of the first embodiment by using the determined value of $C_{N-1}$, thereby generating the multiplied signal.

In a modified embodiment 2, a table in which the temperature and $C_{N-1}$ are associated with each other is stored in advance in the flash memory 54, for example, and in S706, the controller 50 determines $C_{N-1}$, based on the table and the temperature acquired in S705. Alternatively, for example, data of a relation equation between the temperature and $C_{N-1}$ is stored in advance in the flash memory 54, and in S706, the controller 50 determines $C_{N-1}$, based on the data of the relation equation and the temperature acquired in S705.

A viscosity of grease applied between the carriage 2 and the guide rails 11 and 12 is changed by the temperature, so that the moving speed of the carriage 2, i.e., the detection time period when there are no contaminants and the like attached to the encoder scale 18 is changed due to the influence. In the modified embodiment 1, the controller 50 calculates $C_{N-1}$ based on a detection result of the temperature sensor 201. Thereby, the time interval of the multiplied signals calculated based on $C_{N-1}$ can be made appropriate.

In the modified embodiment 2, values of $C_1$, $C_2$, . . . are stored in advance in the flash memory 54 ("memory" of the present disclosure). The stored values of $C_1$, $C_2$, . . . are obtained in advance by a test and the like.

Figure 20:
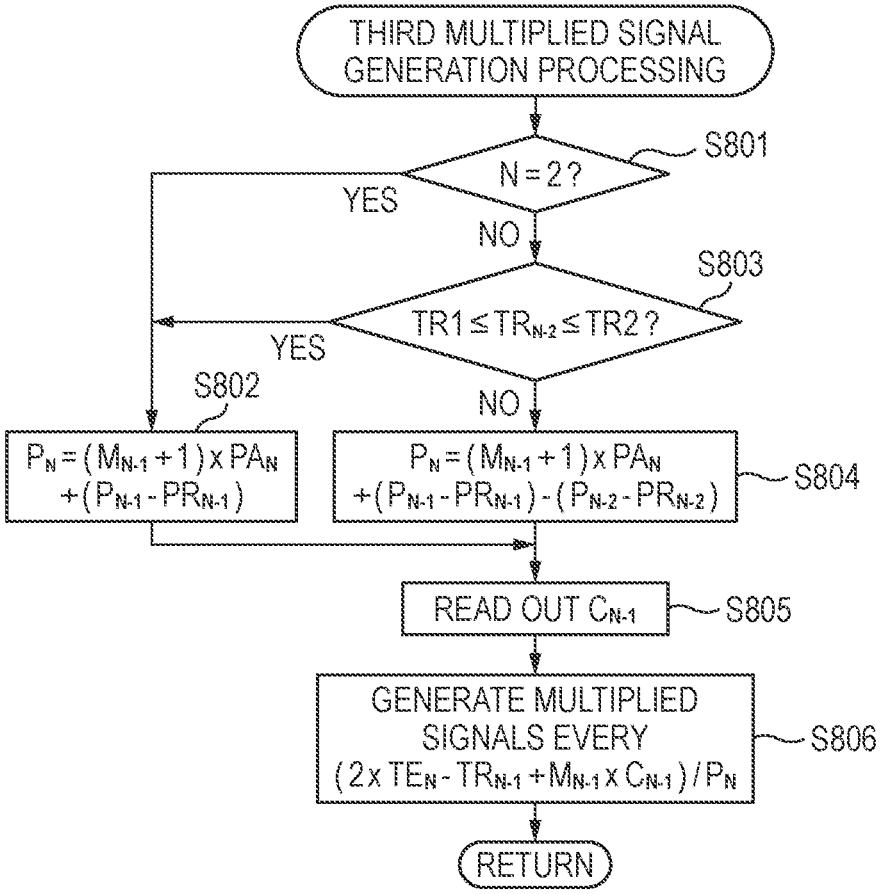
FIG. 20 is a flowchart depicting a flow of third multiplied signal generation processing in a modified embodiment 2.

In the modified embodiment 2, as shown in FIG. 20, in the third multiplied signal generation processing, the controller 50 executes processing of S801 to S804 similar to S401 to S404 of the first embodiment. Then, after calculating $P_N$ in processing of S802 or S804, the controller 50 reads out the value of $C_{N-1}$ stored in the flash memory 54 (S805), and executes processing of S806 similar to S406 of the first embodiment by using the read value of $C_{N-1}$, thereby generating the multiplied signal.

In the modified embodiment 2, since the appropriate value of $C_{N-1}$ is obtained by a test and the like and is stored in the flash memory 54, it is not necessary to execute the processing for calculating $C_{N-1}$.

In the first embodiment, the value of the position parameter U that is increased or decreased each time a rise of the encoder signal is detected is corrected to increase or decrease when the time of $2\times TE_N$ elapses from the detection of the encoder and each time $TE_N$ elapses thereafter. Thereby, the position parameter U can accurately correspond to the position of the carriage 2 in the scanning direction. However, the present invention is not limited thereto. For example, the position parameter U that is increased or decreased each time a rise of the encoder signal is detected may be corrected by other methods so that the value corresponds to the position of the carriage 2.

In the first and second embodiments, assuming that contaminants are attached to the encoder scale 18 or the encoder disk 121 in diverse aspects, in each of cases where $TR_{N-1}$ is shorter than TR1 and where $TR_{N-1}$ is longer than TR2, the processing for determining the time interval for generating the multiplied signals is made different from the case where $TR_{N-1}$ is equal to or longer than TR1 and equal to or shorter than TR2. When $TR_{N-2}$ is shorter than TR1 and when $TR_{N-2}$ is longer than TR2, the value of $P_N$ is set as a value obtained by subtracting $[P_{N-1}-PR_{N-1}]$ from the value of $P_N$ when $TR_{N-2}$ is equal to or longer than TR1 and equal to or shorter than TR2. However, the present invention is not limited thereto.

Figure 21:
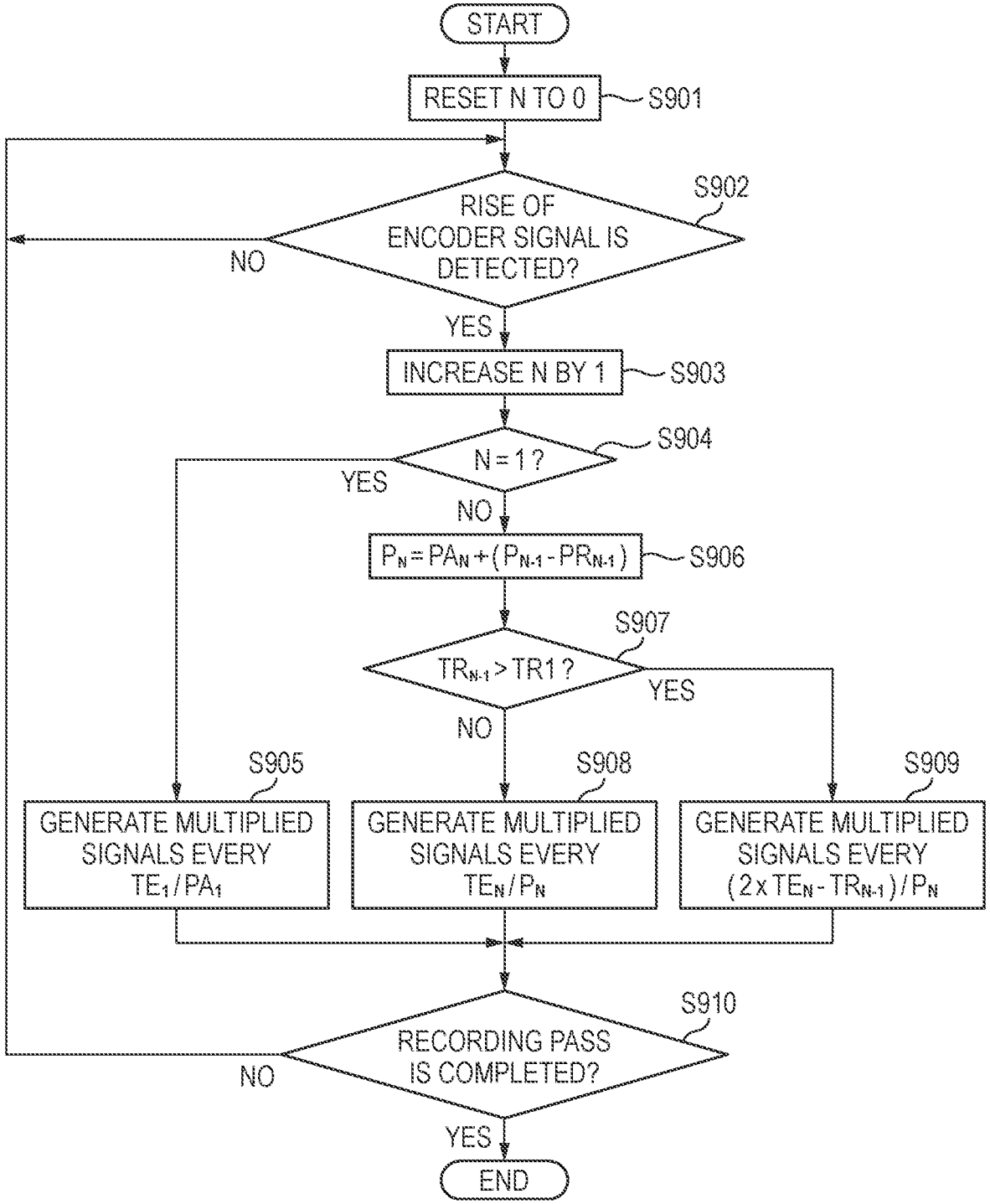
FIG. 21 is a flowchart depicting a processing flow for generating multiplied signals in a modified embodiment 3.

In a modified embodiment 3, in the printer 1 of the first embodiment, the controller 50 executes processing according to a flow shown in FIG. 21, thereby generating the multiplied signal.

More specifically, processing of S901 to S904 and S910 of the flow shown in FIG. 21 is similar to the processing of S101 to S105 and S111 of the first embodiment. In the modified embodiment 3, when N is 2 or greater (S904: NO), the controller 50 calculates $P_N$ based on $P_N=PA_N+(P_{N-1}-PR_{N-1})$ (S906). When $TR_{N-1}$ is equal to or longer than TR1 (S907: NO), the controller 50 generates the multiplied signals every $[TE_N/P_N]$ (S908), and proceeds to S910. When $TR_{N-1}$ is shorter than TR1 (S907: YES), the controller 50 generates the multiplied signals every $[(2\times TE_N-TR_N-)/P_N]$ (909), and proceeds to S910.

Figure 22:
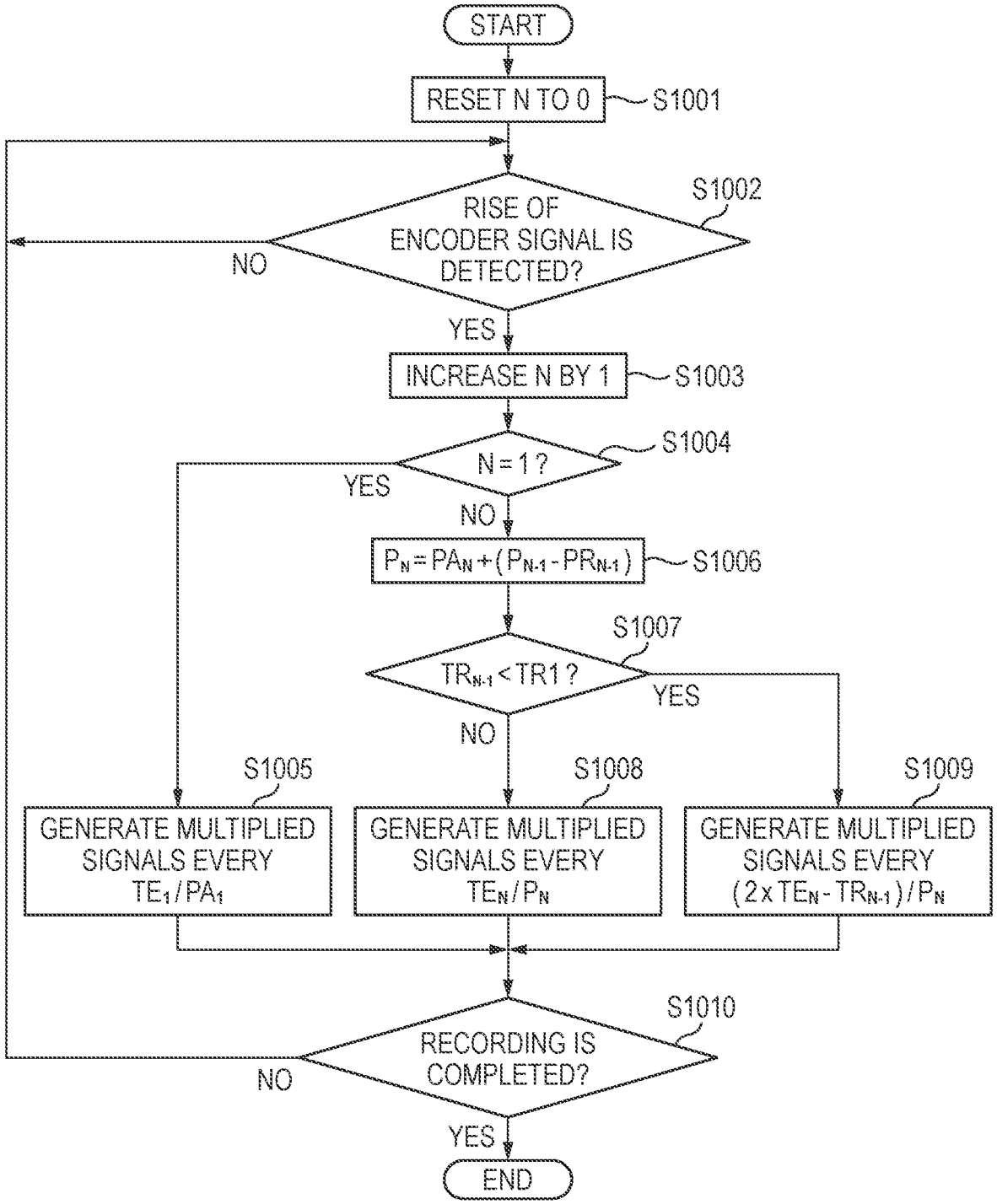
FIG. 22 is a flowchart depicting a processing flow for generating multiplied signals in a modified embodiment 4.

In a modified embodiment 4, in the printer 101 of the second embodiment, the controller 50 executes processing according to a flow shown in FIG. 22, thereby generating the multiplied signal. Processing of S1001 to S1009 of the flow shown in FIG. 22 is similar to the processing of S901 to S909 of the modified embodiment 3. Processing of S1010 of the flow shown in FIG. 22 is similar to S611 of the second embodiment.

For example, contaminants are little attached to the encoder scale 18 or the encoder disk 121, and even when contaminants are attached, an amount of attachment thereof may be relatively small, depending on the printers. In this case, $TR_{N-1}$ is expected to be shorter than TR1 but $TR_{N-1}$ is not expected to be longer than TR2. In this case, it is assumed that a plurality of contaminants is not attached to a part close to the encoder scale 18 or the encoder disk 121, and when $TR_{N-1}$ is shorter than TR1, $TR_{N-2}$ is equal to or longer than TR1 and becomes TR2.

In such printer, like the modified embodiments 3 and 4, when $TR_{N-1}$ is shorter than TR1, the processing for generating the multiplied signals is made different from the case where $TR_{N-1}$ is equal to or longer than TR1. Thereby, it is possible to generate the multiplied signals at appropriate time intervals.

Figure 23:
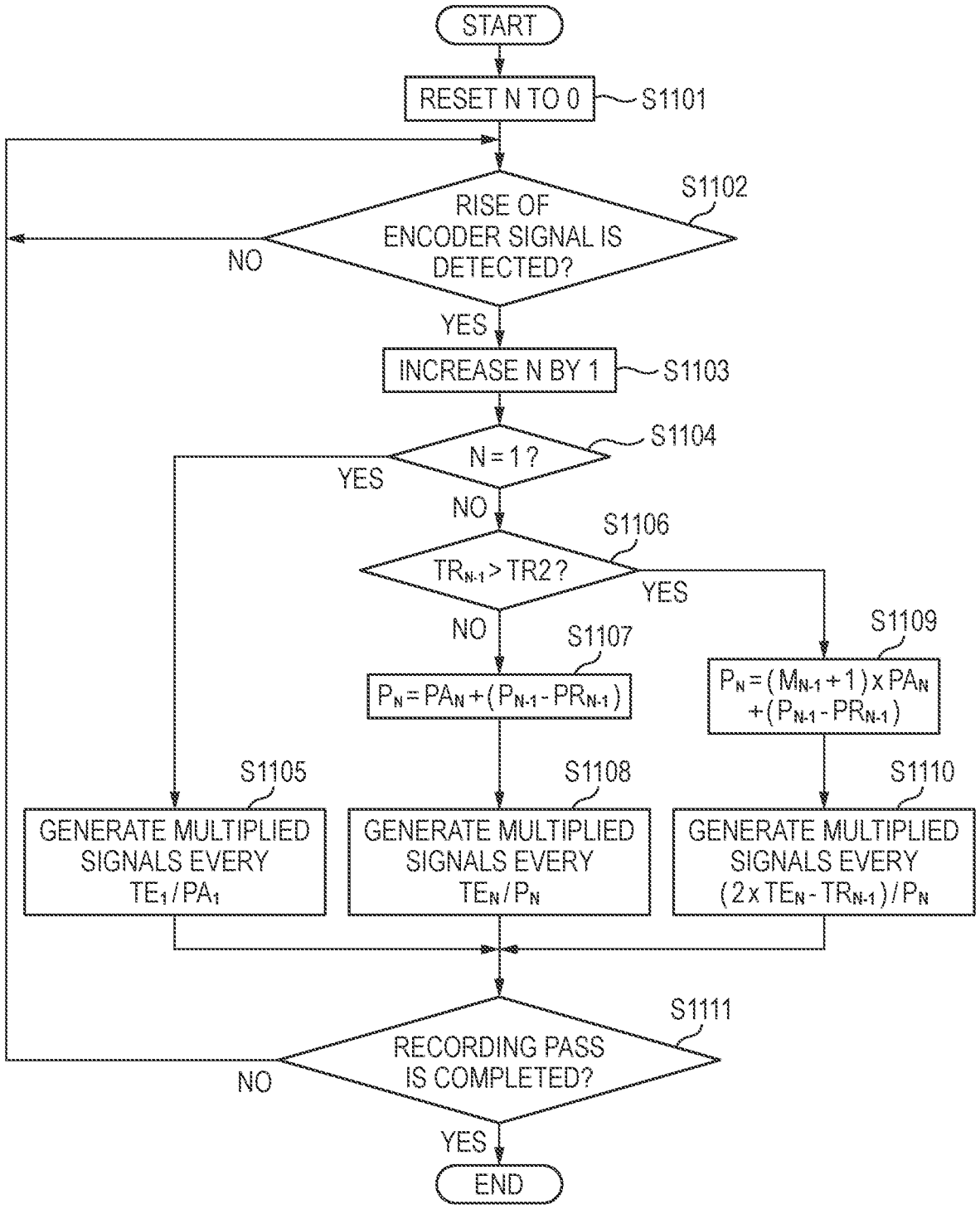
FIG. 23 is a flowchart depicting a processing flow for generating multiplied signals in a modified embodiment 5.

In a modified embodiment 5, in the printer 1 of the first embodiment, the controller 50 executes processing according to a flow shown in FIG. 23, thereby generating the multiplied signal.

More specifically, processing of S1101 to S1105 and S1111 of the flow shown in FIG. 23 is similar to the processing of S101 to S105 and S111 of the first embodiment. In the modified embodiment 5, when N is 2 or greater (S1104: NO) and $TR_{N-1}$ is equal to or shorter than TR2 (S1106: NO), the controller 50 calculates $P_N$ based on $P_N=PA_N+(P_{N-1}-PR_{N-1})$ (S1107), generates the multiplied signals every $[TE_N/P_N]$ (S1108), and proceeds to S1111.

On the other hand, when N is 2 or greater (1104: NO) and $TR_{N-1}$ is longer than TR2 (S1106: NO), the controller 50 calculates $P_N$ based on $P_N=(M_{N-1}+1)\times PA_N+(P_{N-1}-PR_{N-1})$ (S1109), generates the multiplied signals every $[(2\times TE_N-TR_{N-1})/P_N]$ (S1110), and proceeds to S1111.

Figure 24:
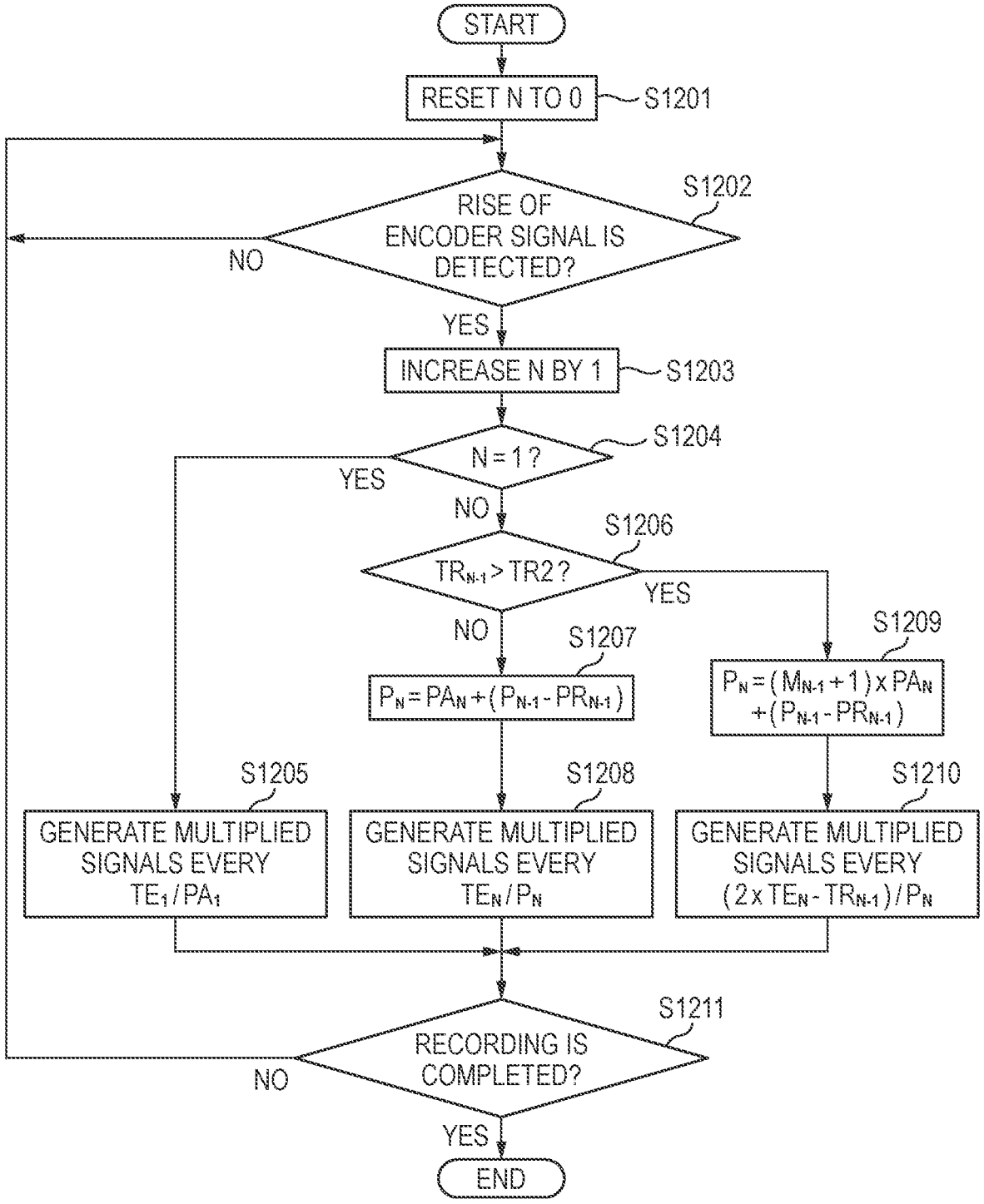
FIG. 24 is a flowchart depicting a processing flow for generating multiplied signals in a modified embodiment 6.

In a modified embodiment 6, in the printer 101 of the second embodiment, the controller 50 executes processing according to a flow shown in FIG. 24, thereby generating the multiplied signal. Processing of S1201 to S1210 of the flow shown in FIG. 24 is similar to the processing of S1101 to S1110 of the modified embodiment 4. Processing of S1211 of the flow shown in FIG. 24 is similar to S611 of the second embodiment.

For example, contaminants are little attached to the encoder scale 18 or the encoder disk 121, the intervals between the encoder slits 18*a*; 121*a* are short, and when contaminants are attached, the contaminants may extend over the entire length of the encoder slit 18*a*; 121*a*, depending on the printers. In this case, $TR_{N-1}$ is expected to be longer than TR2 but $TR_{N-1}$ is not expected to be shorter than TR1. In this case, it is assumed that a plurality of contaminants is not attached to a part close to the encoder scale 18 or the encoder disk 121, and when $TR_{N-1}$ is longer than TR2, $TR_{N-2}$ is equal to or longer than TR1 and becomes TR2.

In such printer, like the modified embodiments 5 and 6, when $TR_{N-1}$ is shorter than TR1, the processing for generating the multiplied signals is made different from the case where $TR_{N-1}$ is equal to or longer than TR1. Thereby, it is possible to generate the multiplied signals at appropriate time intervals.

In the first and second embodiments, the multiplied signals are generated based on the rise timing of the encoder signal, for example. However, the present invention is not limited thereto. For example, the multiplied signals may be generated based on a fall timing of the encoder signal. In this case, a fall of the encoder signal corresponds to "signal change" of the present disclosure.

In the first embodiment, the linear encoder 8 has such configuration that the light-emitting element 19*a* and the light-receiving element 19*b* of the encoder sensor 19 are disposed with the encoder scale 18 being sandwiched therebetween, and when the light-emitting element 19*a* and the light-receiving element 19*b* face the encoder slit 18*a* of the encoder scale 18, the light irradiated from the light-emitting element 19*a* is received in the light-receiving element 19*b*. However, the present invention is not limited thereto. For example, in the first embodiment, the linear encoder may have such configuration that the light-emitting element and the light-receiving element are provided on the same side with respect to the encoder scale, and when the light-emitting element and the light-receiving element do not face the encoder slit, the light irradiated from the light-emitting element is reflected on the encoder scale and is then received in the light-receiving element. Similarly, in the second embodiment, the rotary encoder may have such configuration that the light-emitting element and the light-receiving element are provided on the same side with respect to the encoder disk, and when the light-emitting element and the light-receiving element do not face the encoder slit, the light irradiated from the light-emitting element is reflected on the encoder disk and is then received in the light-receiving element.

In the above, the present disclosure is applied to the printer configured to discharge the inks from the nozzles, thereby performing recording on the recording sheet P. However, the present invention is not limited thereto. For example, the present disclosure can also be applied to a liquid discharge apparatus configured to record an image by discharging inks to a to-be-recorded medium other than the recording sheet, such as a T-shirts, a sheet for outdoor advertisement, a case of a portable terminal such as a smartphone, a corrugated cardboard, a resin member and the like. The present disclosure can also be applied to a liquid discharge apparatus configured to discharge liquid other than ink, such as liquidous resin or metal.

What is claimed is:

1. A liquid discharge apparatus comprising:

a liquid discharge head having a nozzle;

a carriage having the liquid discharge head mounted thereto, and configured to move in a scanning direction;

an encoder sensor mounted to the carriage;

a slit member extending in the scanning direction, and having a plurality of encoder slits aligned in the scanning direction and detected by the encoder sensor; and a controller configured to:

move the carriage in the scanning direction;

generate a plurality of multiplied signals by multiplying a detection signal obtained based on a detection result of the encoder slits by the encoder sensor, in a case where a signal change occurs in the detection signal, the signal change being either a rise or a fall of the detection signal; and cause the liquid discharge head to discharge liquid from the nozzle, based on the plurality of multiplied signals, wherein in a case where the controller generates the plurality of multiplied signals as a result of occurrence of an $N^{th}$ signal change in the detection signal after starting to move the carriage, where N is a natural number of 2 or greater, the controller is configured to calculate a target value $P_N$ of a number of the multiplied signals that are generated in a case where the $N^{th}$ signal change occurs, based on $P_N=PA_N+(P_{N-1}-PR_{N-1})$, where $P_{N-1}$ is a target value of a number of the multiplied signals that are generated in a case where an $[N-1]^{th}$ signal change occurs in the detection signal, $PR_{N-1}$ is a number of the multiplied signals that are actually generated during an $[N-1]^{th}$ detection time period that is a period of time from the $[N-1]^{th}$ signal change to the $N^{th}$ signal change, and $PA_N$ is a standard value of a number of the multiplied signals for an $N^{th}$ detection time period, in a case where an actual length $TR_{N-1}$ of the $[N-1]^{th}$ detection time period is equal to or longer than a predetermined first time and equal to or shorter than a predetermined second time, the controller is configured to generate the multiplied signals for each time calculated as $[TE_N/P_N]$ in the case where the $N^{th}$ signal change occurs, where $TE_N$ is a standard value of a length of the $N^{th}$ detection time period, and in a case where the actual length $TR_{N-1}$ is shorter than the predetermined first time, the controller is configured to generate the multiplied signals for each time calculated as $[(2\times TE_N-TR_{N-1})/P_N]$ in the case where the $N^{th}$ signal change occurs.

2. The liquid discharge apparatus according to claim 1, wherein the controller is configured to acquire position information of the carriage in the scanning direction, based on a value of a position parameter corresponding to a position of the carriage in the scanning direction, and in a case of moving the carriage to one side in the scanning direction, the controller is configure to:

increase the value of the position parameter by a predetermined value each time the signal change is detected; and increase the value of the position parameter by the predetermined value in a case where a time of $2\times TE_N$ elapses without detecting an $[N+1]^{th}$ signal change since the $N^{th}$ signal change is detected, and increase the value of the position parameter by the predetermined value each time $TE_N$ elapses, until the $[N+1]^{th}$ signal change is thereafter detected, and in a case of moving the carriage to the other side in the scanning direction, the controller is configure to:

decrease the value of the position parameter corresponding to the position of the carriage in the scanning direction each time the signal change is detected; and decrease the value of the position parameter by the predetermined value in the case where a time of $2\times TE_N$ elapses without detecting the $[N+1]^{th}$ signal change since the $N^{th}$ signal change is detected, and decrease the value of the position parameter by the predetermined value each time $TE_N$ elapses, until the $[N+1]^{th}$ signal change is thereafter detected.

3. The liquid discharge apparatus according to claim 1, wherein in a case where the actual length $TR_{N-1}$ is equal to or longer than the predetermined first time and equal to or shorter than the predetermined second time, and an actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[TE_N/P_N]$ in the case where the $N^{th}$ signal change occurs, in a case where the actual length $TR_{N-1}$ is equal to or longer than the predetermined first time and equal to or shorter than the predetermined second time, and the actual length $TR_{N-2}$ is shorter than the predetermined first time or longer than the predetermined second time, the controller is configure to:

calculate $P_N$, based on $P_N=PA_N+(P_{N-1}-PR_{N-1})-(P_{N-2}-PR_{N-2})$; and generate the multiplied signals for each time calculated as $[TE_N/P_N]$ in the case where the $N^{th}$ signal change occurs, in a case where the actual length $TR_{N-1}$ is shorter than the predetermined first time, and the actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[(2\times TE_N-TR_{N-1})/P_N]$ in the case where the $N^{th}$ signal change occurs, in a case where the actual length $TR_{N-1}$ is shorter than the predetermined first time, and the actual length $TR_{N-2}$ is shorter than the predetermined first time or longer than the predetermined second time, the controller is configured to:

calculate $P_N$, based on $P_N=PA_N+(P_{N-1}-PR_{N-1})-(P_{N-2}-PR_{N-2})$; and generate the multiplied signals for each time calculated as $[(2\times TE_N-TR_{N-1})/P_N]$ in the case where the $N^{th}$ signal change occurs, in a case where the actual length $TR_{N-1}$ is longer than the predetermined second time, and the actual length $TR_{N-2}$ is equal to or longer than the predetermined first time and equal to or shorter than the predetermined second time, the controller is configure to:

calculate $P_N$, based on $P_N=(M_{N-1}+1)\times PA_N+(P_{N-1}-PR_{N-1})$, where $M_{N-1}$ is a number of the encoder slits that are not detected during the $[N-1]^{th}$ detection time period, and generate the multiplied signals for each time calculated as $[(2\times TE_N-TR_{N-1}+M_{N-1}\times C_{N-1})/P_N]$ in the case where the $N^{th}$ signal change occurs, where $C_{N-1}$ is a standard value of a length of the $[N-1]^{th}$ detection time period, and in a case where the actual length $TR_{N-1}$ is longer than the predetermined second time, and the actual length $TR_{N-2}$ is shorter than the predetermined first time or longer than the predetermined second time, the controller is configured to:

calculate $P_N$, based on $(PA\,N--PR_{N-1})-(P_{N-2}-PR_{N-2})$; and generate the multiplied signals for each time calculated as $[(2\times TE_N-TR_{N-1}+M_{N-1}\times C_{N-1})/P_N]$ in the case where the $N^{th}$ signal change occurs.

4. A liquid discharge apparatus comprising:

a liquid discharge head having a nozzle;

a conveyor configured to convey a medium, to which liquid is discharged from the nozzle, in a conveying direction;

an encoder sensor;

a slit member configured to relatively move in a predetermined direction with respect to the encoder sensor in a case where the medium is conveyed by the conveyor, and having a plurality of encoder slits aligned in the predetermined direction and detected by the encoder sensor; and a controller configured to:

cause the conveyor to convey the medium;

generate a plurality of multiplied signals by multiplying a detection signal obtained based on a detection result of the encoder slits by the encoder sensor, in a case where a signal change occurs in the detection signal, the signal change being either a rise or a fall of the detection signal; and cause the liquid discharge head to discharge liquid from the nozzle, based on the plurality of multiplied signals, wherein in a case where the controller generates the plurality of multiplied signals as a result of occurrence of an $N^{th}$ signal change in the detection signal after starting to convey the medium, where N is a natural number of 2 or greater, the controller is configured to calculate a target value $P_N$ of a number of the multiplied signals that are generated in a case where the $N^{th}$ signal change occurs, based on $P_N=PA_N+(P_{N-1}-PR_{N-1})$, where $P_{N-1}$ is a target value of a number of the multiplied signals that are generated in a case where an $[N-1]^{th}$ signal change occurs in the detection signal, $PR_{N-1}$ is a number of the multiplied signals that are actually generated during an $[N-1]^{th}$ detection time period that is a period of time from the $[N-1]^{th}$ signal change to the $N^{th}$ signal change, and $PA_N$ is a standard value of a number of the multiplied signals for an $N^{th}$ detection time period, in a case where an actual length $TR_{N-1}$ of the $[N-1]^{th}$ detection time period is equal to or longer than a predetermined first time and equal to or shorter than a predetermined second time, the controller generates the multiplied signals for each time calculated as $[TE_N/P_N]$ in the case where the $N^{th}$ signal change occurs, where $TE_N$ is a standard value of a length of the $N^{th}$ detection time period, and in a case where the actual length $TR_{N-1}$ is shorter than the predetermined first time, the controller is configured to generate the multiplied signals for each time calculated as $[(2\times TE_N-TR_{N-1})/P_N]$ in a case where the $N^{th}$ signal change occurs.

5. The liquid discharge apparatus according to claim 4, wherein in a case where the actual length $TR_{N-1}$ is equal to or longer than the predetermined first time and equal to or shorter than the predetermined second time, and an actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[TE_N/P_N]$ in the case where the $N^{th}$ signal change occurs, in a case where the actual length $TR_{N-1}$ is equal to or longer than the predetermined first time and equal to or shorter than the predetermined second time, and the actual length $TR_{N-2}$ is shorter than the predetermined first time or longer than the predetermined second time, the controller is configure to:

calculate $P_N$, based on $P_N=PA_N+(P_{N-1}-PR_{N-1})-(P_{N-2}-PR_{N-2})$; and generate the multiplied signals for each time calculated as $[TE_N/P_N]$ in the case where the $N^{th}$ signal change occurs, in a case where the actual length $TR_{N-1}$ is shorter than the predetermined first time, and the actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[(2\times TE_N-TR_{N-1})/P_N]$ in the case where the $N^{th}$ signal change occurs, in a case where the actual length $TR_{N-1}$ is shorter than the predetermined first time, and the actual length $TR_{N-2}$ is shorter than the predetermined first time or longer than the predetermined second time, the controller is configured to:

calculate $P_N$, based on $P_N=PA_N+(P_{N-1}-PR_{N-1})-(P_{N-2}-PR_{N-2})$; and generate the multiplied signals for each time calculated as $[(2\times TE_N-TR_{N-1})/P_N]$ in the case where the $N^{th}$ signal change occurs, in a case where the actual length $TR_{N-1}$ is longer than the predetermined second time, and the actual length $TR_{N-2}$ is equal to or longer than the predetermined first time and equal to or shorter than the predetermined second time, the controller is configure to:

calculate $P_N$, based on $P_N=(M_{N-1}+1)\times PA_N+(P_{N-1}-PR_{N-1})$, where $M_{N-1}$ is a number of the encoder slits that are not detected during the $[N-1]^{th}$ detection time period, and generate the multiplied signals for each time calculated as $[(2\times TE_N-TR_{N-1}+M_{N-1}\times C_{N-1})/P_N]$ in the case where the $N^{th}$ signal change occurs, where $C_{N-1}$ is a standard value of a length of the $[N-1]^{th}$ detection time period, and in a case where the actual length $TR_{N-1}$ is longer than the predetermined second time, and the actual length $TR_{N-2}$ is shorter than the predetermined first time or longer than the predetermined second time, the controller is configured to:

calculate $P_N$, based on $(PA\,N--PR_{N-1})-(P_{N-2}-PR_{N-2})$; and generate the multiplied signals for each time calculated as $[(2\times TE_N-TR_{N-1}+M_{N-1}\times C_{N-1})/P_N]$ in the case where the $N^{th}$ signal change occurs.

6. A liquid discharge apparatus comprising:

a liquid discharge head having a nozzle;

a carriage having the liquid discharge head mounted thereto, and configured to move in a scanning direction;

an encoder sensor mounted to the carriage;

a slit member extending in the scanning direction, and having a plurality of encoder slits aligned in the scanning direction and detected by the encoder sensor; and a controller configured to:

move the carriage in the scanning direction;

generate a plurality of multiplied signals by multiplying a detection signal obtained based on a detection result of the encoder slits by the encoder sensor, in a case where a signal change occurs in the detection signal, the signal change being either a rise or a fall of the detection signal; and cause the liquid discharge head to discharge liquid from the nozzle, based on the plurality of multiplied signals, wherein in a case where the controller generates the plurality of multiplied signals as a result of occurrence of an $N^{th}$ signal change in the detection signal after starting to move the carriage, where N is a natural number of 2 or greater, in a case where an actual length $TR_{N-1}$ of an $[N-1]^{th}$ detection time period that is a period of time from an $[N-1]^{th}$ signal change to an $N^{th}$ signal change is equal to or longer than a predetermined first time and equal to or shorter than a predetermined second time, the controller is configured to:

calculate a target value $P_N$ of a number of the multiplied signals that are generated in a case where the $N^{th}$ signal change occurs, based on $P_N=PA_N+(P_{N-1}-PR_{N-1})$, where $PR_{N-1}$ is a number of the multiplied signals that are actually generated during the $[N-1]^{th}$ detection time period, and $PA_N$ is a standard value of a number of the multiplied signals for an $N^{th}$ detection time period, and generate the multiplied signals for each time calculated as $[TE_N/P_N]$ in a case where the $N^{th}$ signal change occurs, where $TE_N$ is a standard value of a length of the $N^{th}$ detection time period, and in a case where the actual length $TR_{N-1}$ is longer than the predetermined second time, the controller is configured to:

calculate the target value $P_N$ of the number of the multiplied signals that are generated in the case where the $N^{th}$ signal change occurs, based on $P_N=(M_{N-1}+1)\times PA_N+(P_{N-1}-PR_{N-1})$, where $M_{N-1}$ is a number of the encoder slits that are not detected during the [N−1] detection time period, and generate the multiplied signals for each time calculated as $[(2\times TE_N-TR_{N-1}+M_{N-1}\times C_{N-1})/P_N]$ in the case where the $N^{th}$ signal change occurs, where $C_{N-1}$ is a standard value of a length of the $[N-1]^{th}$ detection time period.

7. The liquid discharge apparatus according to claim 6, wherein $C_{N-1}$ is an average value of lengths of past detection time periods before the $N^{th}$ detection time period.

8. The liquid discharge apparatus according to claim 6, further comprising a temperature sensor, wherein the controller is configured to calculate $C_{N-1}$, based on a detection result of the temperature sensor.

9. The liquid discharge apparatus according to claim 6, further comprising a memory, wherein a value of $C_{N-1}$ is stored in advance in the memory.

10. The liquid discharge apparatus according to claim 6, wherein the controller is configured to acquire position information of the carriage in the scanning direction, based on a value of a position parameter corresponding to a position of the carriage in the scanning direction, and in a case of moving the carriage to one side in the scanning direction, the controller is configure to:

increase the value of the position parameter by a predetermined value each time the signal change is detected; and increase the value of the position parameter by the predetermined value in a case where a time of $2\times TE_N$ elapses without detecting an $[N+1]^{th}$ signal change since the $N^{th}$ signal change is detected, and increase the value of the position parameter by the predetermined value each time $TE_N$ elapses, until the $[N+1]^{th}$ signal change is thereafter detected, and in a case of moving the carriage to the other side in the scanning direction, the controller is configure to:

decrease the value of the position parameter corresponding to the position of the carriage in the scanning direction each time the signal change is detected; and decrease the value of the position parameter by the predetermined value in the case where a time of $2\times TE_N$ elapses without detecting the $[N+1]^{th}$ signal change since the $N^{th}$ signal change is detected, and decrease the value of the position parameter by the predetermined value each time $TE_N$ elapses, until the $[N+1]^{th}$ signal change is thereafter detected.

11. The liquid discharge apparatus according to claim 6, wherein in a case where the actual length $TR_{N-1}$ is equal to or longer than the predetermined first time and equal to or shorter than the predetermined second time, and an actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[TE_N/P_N]$ in the case where the $N^{th}$ signal change occurs, in a case where the actual length $TR_{N-1}$ is equal to or longer than the predetermined first time and equal to or shorter than the predetermined second time, and the actual length $TR_{N-2}$ is shorter than the predetermined first time or longer than the predetermined second time, the controller is configure to:

calculate $P_N$, based on $P_N=PA_N+(P_{N-1}-PR_{N-1})-(P_{N-2}-PR_{N-2})$; and generate the multiplied signals for each time calculated as $[TE_N/P_N]$ in the case where the $N^{th}$ signal change occurs, in a case where the actual length $TR_{N-1}$ is shorter than the predetermined first time, and the actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[(2\times TE_N-TR_{N-1})/P_N]$ in the case where the $N^{th}$ signal change occurs, in a case where the actual length $TR_{N-1}$ is shorter than the predetermined first time, and the actual length $TR_{N-2}$ is shorter than the predetermined first time or longer than the predetermined second time, the controller is configured to:

calculate $P_N$, based on $P_N=PA_N+(P_{N-1}-PR_{N-1})-(P_{N-2}-PR_{N-2})$; and generate the multiplied signals for each time calculated as $[(2\times TE_N-TR_{N-1})/P_N]$ in the case where the $N^{th}$ signal change occurs, in a case where the actual length $TR_{N-1}$ is longer than the predetermined second time, and the actual length $TR_{N-2}$ is equal to or longer than the predetermined first time and equal to or shorter than the predetermined second time, the controller is configure to:

calculate $P_N$, based on $P_N=(M_{N-1}+1)\times PA_N+(P_{N-1}-PR_{N-1})$, where $M_{N-1}$ is a number of the encoder slits that are not detected during the $[N-1]^{th}$ detection time period, and generate the multiplied signals for each time calculated as $[(2\times TE_N-TR_{N-1}+M_{N-1}\times C_{N-1})/P_N]$ in the case where the $N^{th}$ signal change occurs, where $C_{N-1}$ is a standard value of a length of the $[N-1]^{th}$ detection time period, and in a case where the actual length $TR_{N-1}$ is longer than the predetermined second time, and the actual length $TR_{N-2}$ is shorter than the predetermined first time or longer than the predetermined second time, the controller is configured to:

calculate $P_N$, based on $(PA\ N--PR_{N-1})-(P_{N-2}-PR_{N-2})$; and generate the multiplied signals for each time calculated as $[(2\times TE_N-TR_{N-1}+M_{N-1}\times C_{N-1})/P_N]$ in the case where the $N^{th}$ signal change occurs.

12. A liquid discharge apparatus comprising:

a liquid discharge head having a nozzle;

a conveyor configured to convey a medium, to which liquid is discharged from the nozzle, in a conveying direction;

an encoder sensor;

a slit member configured to relatively move in a predetermined direction with respect to the encoder sensor in a case where the medium is conveyed by the conveyor, and having a plurality of encoder slits aligned in the predetermined direction and detected by the encoder sensor; and a controller configured to:

cause the conveyor to convey the medium;

generate a plurality of multiplied signals by multiplying a detection signal obtained based on a detection result of the encoder slits by the encoder sensor, in a case where a signal change occurs in the detection signal, the signal change being either a rise or a fall of the detection signal; and cause the liquid discharge head to discharge liquid from the nozzles, based on the plurality of multiplied signals, wherein in a case where the controller generates the plurality of multiplied signals as a result of occurrence of an $N^{th}$ signal change in the detection signal after starting to convey the medium, where N is a natural number of 2 or greater, in a case where an actual length $TR_{N-1}$ of an $[N-1]^{th}$ detection time period that is a period of time from an $[N-1]^{th}$ signal change to an $N^{th}$ signal change is equal to or longer than a predetermined first time and equal to or shorter than a predetermined second time, the controller is configured to:

calculate a target value $P_N$ of a number of the multiplied signals that are generated in a case where the $N^{th}$ signal change occurs, based on $P_N=PA_N+(P_{N-1}-PR_{N-1})$, where $PR_{N-1}$ is a number of the multiplied signals that are actually generated during the $[N-1]^{th}$ detection time period, and $PA_N$ is a standard value of a number of the multiplied signals for an $N^{th}$ detection time period, and generate the multiplied signals for each time calculated as $[TE_N/P_N]$ in a case where the $N^{th}$ signal change occurs, where $TE_N$ is a standard value of a length of the $N^{th}$ detection time period, and in a case where the actual length $TR_{N-1}$ is longer than the predetermined second time, the controller is configured to:

calculate the target value $P_N$ of the number of the multiplied signals that are generated in the case where the $N^{th}$ signal change occurs, based on $P_N=(M_{N-1}+1)\times PA_N+(P_{N-1}-PR_{N-1})$, where $M_{N-1}$ is a number of the encoder slits that are not detected during the [N−1] detection time period, and generate the multiplied signals for each time calculated as $[(2\times TE_N-TR_{N-1}+M_{N-1}\times C_{N-1})/P_N]$ in a case where the $N^{th}$ signal change occurs, where $C_{N-1}$ is a standard value of a length of the $[N-1]^{th}$ detection time period.

13. The liquid discharge apparatus according to claim 12, wherein $C_{N-1}$ is an average value of lengths of past detection time periods before the $N^{th}$ detection time period.

14. The liquid discharge apparatus according to claim 12, further comprising a temperature sensor, wherein the controller is configured to calculate $C_{N-1}$, based on a detection result of the temperature sensor.

15. The liquid discharge apparatus according to claim 12, further comprising a memory, wherein a value of $C_{N-1}$ is stored in advance in the memory.

16. The liquid discharge apparatus according to claim 12, wherein in a case where the actual length $TR_{N-1}$ is equal to or longer than the predetermined first time and equal to or shorter than the predetermined second time, and an actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[TE_N/P_N]$ in the case where the $N^{th}$ signal change occurs, in a case where the actual length $TR_{N-1}$ is equal to or longer than the predetermined first time and equal to or shorter than the predetermined second time, and the actual length $TR_{N-2}$ is shorter than the predetermined first time or longer than the predetermined second time, the controller is configure to:

calculate $P_N$, based on $P_N=PA_N+(P_{N-1}-PR_{N-1})-(P_{N-2}-PR_{N-2})$; and generate the multiplied signals for each time calculated as $[TE_N/P_N]$ in the case where the $N^{th}$ signal change occurs, in a case where the actual length $TR_{N-1}$ is shorter than the predetermined first time, and the actual length $TR_{N-2}$ is equal to or longer than the predetermined first time and equal to or shorter than the predetermined second time, the controller is configured to:

calculate $P_N$, based on $P_N=PA_N+(P_{N-1}-PR_{N-1})$; and generate the multiplied signals for each time calculated as $[(2\times TE_N-TR_{N-1})/P_N]$ in the case where the $N^{th}$ signal change occurs, in a case where the actual length $TR_{N-1}$ is shorter than the predetermined first time, and the actual length $TR_{N-2}$ is shorter than the predetermined first time or longer than the predetermined second time, the controller is configured to:

calculate $P_N$, based on $P_N=PA_N+(P_{N-1}-PR_{N-1})-(P_{N-2}-PR_{N-2})$; and generate the multiplied signals for each time calculated as $[(2\times TE_N-TR_{N-1})/P_N]$ in the case where the $N^{th}$ signal change occurs, in a case where the actual length $TR_{N-1}$ is longer than the predetermined second time, and the actual length $TR_{N-2}$ is equal to or longer than the predetermined first time and equal to or shorter than the predetermined second time, the controller is configure to:

calculate $P_N$, based on $P_N=(M_{N-1}+1)\times PA_N+(P_{N-1}-PR_{N-1})$, where $M_{N-1}$ is a number of the encoder slits that are not detected during the $[N-1]^{th}$ detection time period, and generate the multiplied signals for each time calculated as $[(2\times TE_N-TR_{N-1}+M_{N-1}\times C_{N-1})/P_N]$ in the case where the $N^{th}$ signal change occurs, where $C_{N-1}$ is a standard value of a length of the $[N-1]^{th}$ detection time period, and in a case where the actual length $TR_{N-1}$ is longer than the predetermined second time, and the actual length $TR_{N-2}$ is shorter than the predetermined first time or longer than the predetermined second time, the controller is configured to:

calculate $P_N$, based on $(PA\ N--PR_{N-1})-(P_{N-2}-PR_{N-2})$; and generate the multiplied signals for each time calculated as $[(2\times TE_N-TR_N-+M_{N-1}\times C_{N-1})/P_N]$ in the case where the $N^{th}$ signal change occurs.

* * * * *